US011548299B2

(12) United States Patent
Yajima

(10) Patent No.: US 11,548,299 B2
(45) Date of Patent: Jan. 10, 2023

(54) PRINTER AND CONTROL METHOD OF PRINTER

(71) Applicant: SEIKO EPSON CORPORATION, Tokyo (JP)

(72) Inventor: Yasushi Yajima, Kamiina-Gun Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/215,030

(22) Filed: Mar. 29, 2021

(65) Prior Publication Data

US 2021/0300079 A1 Sep. 30, 2021

(30) Foreign Application Priority Data

Mar. 30, 2020 (JP) ..... JP2020-060139

(51) Int. Cl.

| | |
|---|---|
| ***B41J 3/60*** | (2006.01) |
| ***B41J 11/00*** | (2006.01) |
| ***B41J 13/00*** | (2006.01) |
| ***B41J 11/66*** | (2006.01) |

(52) U.S. Cl.

CPC ..... *B41J 11/663* (2013.01); *B41J 3/60* (2013.01); *B41J 11/0005* (2013.01); *B41J 13/009* (2013.01)

(58) Field of Classification Search

CPC ... B41J 3/60; B41J 11/66; B41J 11/663; B41J 11/0005; B41J 13/009

See application file for complete search history.

(56) References Cited

U.S. PATENT DOCUMENTS

| | | | | |
|---|---|---|---|---|
| 2002/0051669 | A1* | 5/2002 | Otsuka | B41J 11/70 400/619 |
| 2011/0135372 | A1* | 6/2011 | Sato | B41J 3/60 400/614 |
| 2013/0101331 | A1* | 4/2013 | Morrow | B41J 15/04 400/621 |
| 2014/0125730 | A1* | 5/2014 | Lee | B41J 3/60 347/20 |
| 2019/0030924 | A1 | 1/2019 | Takahashi | |

FOREIGN PATENT DOCUMENTS

JP 2017-177582 A 10/2017

* cited by examiner

*Primary Examiner* — Scott A Richmond
(74) *Attorney, Agent, or Firm* — Workman Nydegger

(57) ABSTRACT

Included are a printing unit configured to perform printing on a medium (P) being transported, a first nipping roller configured to nip the medium at a first nipping position downstream of the printing unit in a transport direction in which the medium is transported, a second nipping roller configured to nip the medium at a second nipping position upstream of the printing unit, and a control unit. During duplex printing for outputting a printed object being the medium after performing printing on a first surface and a second surface, the control unit causes the printing unit to start printing on the first surface of the medium (P) in a nipped state in which the medium is nipped by the first nipping roller and the second nipping roller, and to start printing on the second surface on the medium in the nipped state after printing on the first surface.

8 Claims, 19 Drawing Sheets

PRINTER AND CONTROL METHOD OF PRINTER

The present application is based on, and claims priority from JP Application Serial Number 2020-060139, filed Mar. 30, 2020, the disclosure of which is hereby incorporated by reference herein in its entirety.

BACKGROUND

1. Technical Field

The present disclosure relates to a printer that performs printing by jetting liquid onto a medium and a control method of the printer.

2. Related Art

Hitherto, as a device that performs printing and cutting with respect to roll paper, there has been known a configuration of performing printing on an inner surface of a roll body. JP-A-2017-177582 describes a printer, and discloses a configuration in which, at the time of duplex printing, printing is performed while an inner surface of an elongated medium that is wound up in a roll shape is dealt with as a back surface.

In the printer described in JP-A-2017-177582, the medium has an elongated shape that is wound up in a roll shape. Thus, when the inner surface is positioned on a side of a printing unit, a curl in a direction of approaching the printing unit is formed at a leading end of the medium. This is because of curling caused when the medium is wound up in a roll shape.

When a moisture content of the medium is changed, a size of a curl or changing of a curl differs before changing the moisture content and after changing the moisture content. Thus, when duplex printing is performed in an ink-jet type printer that applies ink onto a medium, a mode in which printing is to be performed on any one of the unprinted surfaces of the medium and a mode in which the medium has one printed surface and printing is to be performed on the other surface may be different from each other in some cases. In JP-A-2017-177582, the medium is nipped in the printing unit. In the ink-jet type printer, printing is performed in a state in which a gap is generated between the printing unit and the medium. Thus, printing is performed in a state in which a mode of a curl varies.

In the ink-jet type printer, for the purpose of controlling a position at which ink is jetted onto the medium, the leading end of the medium is controlled at a predetermined position in a transport path, and a position of the leading end of the medium in the transport path is controlled by a driving amount of a transport unit from a state in which the leading end of the medium is at the predetermined position. However, in this configuration, the position of the leading end of the medium in the transport path with respect to the driving amount of the transport unit differs in a case in which the medium is deformed to be deviated from a presumed transport path and in a case in which the medium does not have such deformation. Therefore, as described above, in the ink-jet type printer for performing printing on the medium that is deformed differently when printing is performed on one surface and printing is performed on the other surface, there is a risk that a position of a printing image on the other surface with respect to the one surface is deviated from a desired position.

SUMMARY

In order to solve the above-mentioned problem, a printer includes a printing unit configured to perform printing on a medium being transported in a transport direction, a first nipping roller configured to nip the medium at a first nipping position downstream of the printing unit in the transport direction in which the medium is transported, a second nipping roller configured to nip the medium at a second nipping position upstream of the printing unit in the transport direction in which the medium is transported, and a control unit configured to control the printing unit, wherein during duplex printing for outputting a printed object obtained by performing printing on a first surface and a second surface of the medium, the control unit causes the printing unit to start printing on the first surface in a nipped state in which the medium is nipped by the first nipping roller and is nipped by the second nipping roller, and causes the printing unit to start printing on the second surface in the nipped state after the printing unit performs printing on the first surface of the medium.

In order to solve the above-mentioned problem, a control method of a printer is a control method of a printer including a printing unit configured to perform printing on a medium being transported in a transport direction, a first nipping roller configured to nip the medium at a first nipping position upstream of the printing unit in the transport direction in which the medium is transported, a second nipping roller configured to nip the medium at a second nipping position downstream of the printing unit in the transport direction in which the medium is transported. Duplex printing, for outputting a printed object obtained by performing printing on a first surface and a second surface of the medium, includes causing the medium to be in a nipped state being nipped by the first nipping roller and by the second nipping roller, causing the printing unit to start printing on the first surface of the medium in the nipped state, and causing the printing unit to start printing on the second surface of the medium in the nipped state after a first printing region is formed at the medium.

DESCRIPTION OF EXEMPLARY EMBODIMENTS

Figure 1:
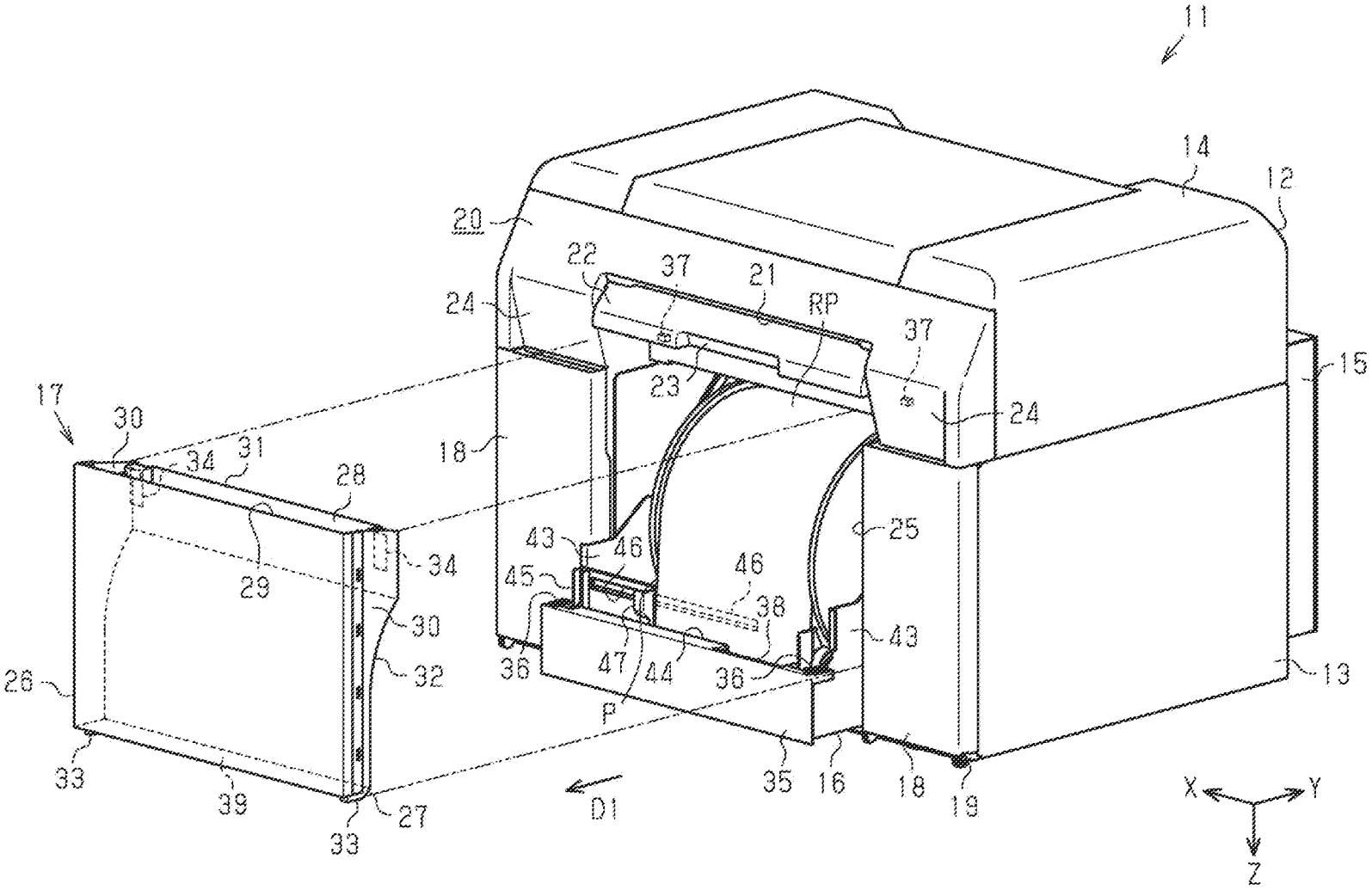
FIG. 1 is an external view illustrating a printer of one exemplary embodiment.

In the drawings, the direction of gravity is indicated by a Z axis while assuming that a printer 11 is placed on a horizontal surface, and directions along a plane intersecting the Z axis are indicated by an X axis and a Y axis. The X axis, the Y axis, and the Z axis are preferably orthogonal to one another, and the X axis and the Y axis preferably follow the horizontal plane. In the following description, the X axis direction is also referred to as a width direction X, the Y axis direction as a depth direction Y, and the Z axis direction as a vertical direction Z.

First Exemplary Embodiment

With reference to the drawings, a printer according to a first exemplary embodiment is described.

As illustrated in FIG. 1, the printer 11 of the present exemplary embodiment includes a housing unit 12 having a substantially rectangular box-like shape. The housing unit 12 includes a first accommodation part 13, a second accommodation part 14 arranged on the −Z side of the first accommodation part 13 in the vertical direction Z, and a third accommodation part 15 arranged on a rear side of the first accommodation part 13.

The housing unit 12 accommodates a drawer unit 16 that is drawable through an opening portion 25 formed in the vicinity of the center of the first accommodation part 13 in the width direction X. The drawer unit 16 includes a front plate portion 35 having an outer surface being a front surface in the present exemplary embodiment, which is exposed when the drawer unit 16 is accommodated in the housing unit 12.

On the −Z side of the front plate portion 35 of the drawer unit 16 accommodated in the housing unit 12 in the vertical direction Z, an accommodation container 17 is removably attached at a position that is aligned with the front plate portion 35 and above the front plate portion 35. The accommodation container 17 includes an outer wall portion 26 that covers the opening portion 25 when being attached to the housing unit 12, and an inner wall portion 27 that forms an accommodation portion 28 with the outer wall portion 26. When the accommodation container 17 is attached to the housing unit 12, the inner wall portion 27 is arranged in the housing unit 12.

The drawer unit 16 includes a hand grip portion 38 arranged on an inner surface side of the front plate portion 35, which enables the drawer unit 16 to be gripped by a hand when being pulled out from the housing unit 12. For example, the hand grip portion 38 is a recessed portion formed on the −X side of the front plate portion 35 in the width direction X.

The accommodation container 17 covers the hand grip portion 38 of the drawer unit 16 accommodated in the housing unit 12 when being attached to the housing unit 12. Meanwhile, the accommodation container 17 exposes the hand grip portion 38 of the drawer unit 16 accommodated in the housing unit 12 when being removed from the housing unit 12.

When the accommodation container 17 is attached, the opening portion 25 is covered with the outer wall portion 26 and the front plate portion 35. The outer wall portion 26 of the accommodation container 17 and the front plate portion 35 of the drawer unit 16 function as a housing of the printer 11.

The outer wall portion 26 and the front plate portion 35 have the same length in the width direction X intersecting both the vertical direction Z and a drawing direction D1 being the −Y side of the drawer unit 16 in the depth direction Y. Further, the outer wall portion 26 has a length in the vertical direction Z, which is longer than the front plate portion 35.

As illustrated in FIG. 1, the inner wall portion 27 of the accommodation container 17 includes a pair of side walls 30 joined to the outer wall portion 26 at both ends in the width direction X, a substantially rectangular plate-like inner wall 31 that forms a reception port 29 with an upper end of the outer wall portion 26, a curved wall 32 that is curved downward from a lower end of the inner wall 31 in a direction of approaching the outer wall portion 26, a bottom wall 39 joined to a lower end of the outer wall portion 26. Further, the accommodation container 17 includes a pair of metal pieces 34 attached to both ends of the inner wall 31 in the width direction X.

On both ends of the bottom wall 39 in the width direction X, the accommodation container 17 includes a pair of engaging projection portions 33 that protrude downward. Meanwhile, on both ends in the width direction X, the front plate portion 35 of the drawer unit 16 includes a pair of supporting recess portions 36 that are opened upward. When being removed from the housing unit 12, the accommodation container 17 is supported by the front plate portion 35 in a state in which the engaging projection portions 33 are engaged with the supporting recess portions 36.

The drawer unit 16 supports a path formation member 45 that forms an insertion port 44 with the front plate portion 35. The path formation member 45 has a guide hole 46 that extends from the +X side to the −X side in the width direction X. A first sensor 71 is positioned before a transport roller pair 51 behind the insertion port 44. When the first sensor 71 detects a leading end of a medium P, the transport roller pair 51 is slightly rotated, the leading end of the medium P is drawn in by the transport roller pair 51, and hence the leading end of the medium P is nipped.

The path formation member 45 supports a positioning member 47 that is movable along the guide hole 46 in the width direction X. The positioning member 47 includes a protruding portion that protrudes in the drawing direction D1 with respect to the guide hole 46. Note that, in the drawer unit 16, the hand grip portion 38 is arranged on the −X side in the width direction X with respect to a movable range of the protruding portion of the positioning member 47.

When a user takes out the accommodation container 17 from the housing unit 12, grips the hand grip portion 38 with a hand, and pulls out the drawer unit 16 in the drawing direction D1, a pair of side wall portions 43 of the drawer unit 16 come to the outside of the housing unit 12. The side wall portions 43 supports a roll body RP in a rotatable manner. For example, the roll body RP is obtained by winding up the medium P being sheet-like paper in a cylindrical shape. Note that the front plate portion 35 is positioned at the front of the roll body RP and the side wall portions 43 in the drawing direction D1 from the housing unit 12. Further, in the present exemplary embodiment, the medium P that is wound up in a cylindrical shape is referred to as the roll body RP.

One of a plurality of roll bodies RP having different winding numbers and widths being lengths in the width direction X is loaded in the drawer unit 16 in a replaceable manner, in a state of being positioned on the −X side in the width direction X. Further, the length in the guide hole 46 in the width direction X and the movable range of the positioning member 47 are set in accordance with a minimum width of the roll body RP loadable in the drawer unit 16.

As illustrated in FIG. 1, on both ends of the first accommodation part 13 in the width direction X, an opening/closing cover 18 is attached in a turnable manner. When an upper end turns about a turning shaft 19 provided to a lower end, the opening/closing cover 18 is arranged at a closing position illustrated in FIG. 1 and an opening position at which the upper end turns frontward to expose the inside. Further, when the opening/closing cover 18 is arranged at the opening position, a cartridge holder (not illustrated) is exposed. An ink cartridge (not illustrated) that accommodates ink being one example of liquid is removably installed in the cartridge holder.

At the front of the second accommodation part 14, a frame member 20 constituting the housing unit 12 is arranged at a position above the accommodation container 17 and the opening/closing cover 18. In the vicinity of the center of the frame member 20 in the width direction X, a discharge port 21 that is opened obliquely downward is formed. Below the discharge port 21 in the frame member 20, a guide portion 22 is formed. The guide portion 22 is curved to be recessed inward and upward from the lower end toward the discharge port 21. Further, at positions below the guide portion 22 and on an inner far side of the housing unit 12 with respect to the guide portion 22, a pair of magnets 37 are attached to the frame member 20.

When the drawer unit 16 is accommodated in the housing unit 12, and the accommodation container 17 is attached to the housing unit 12, the engaging projection portions 33 formed on the lower end are engaged with the supporting recess portions 36 of the drawer unit 16. After that, the upper end of the accommodation container 17 is tilted toward the frame member 20 with the engaging projection portions 33 as a supporting point. With this, the accommodation container 17 is supported by the front plate portion 35 through intermediation of the engaging projection portions 33. At the same time, the metal pieces 34 are attracted by the magnets 37, and hence a self-standing state in which the reception port 29 is oriented to the −Z side in the vertical direction Z is retained.

In the vicinity of the center in the width direction X, a lower end of the guide portion 22 has a lower end-side recess portion 23 that is opened downward and frontward. Further, when the accommodation container 17 is attached to the housing unit 12, the upper end of the outer wall portion 26 is exposed through the lower end-side recess portion 23.

On both ends in the width direction X, the frame member 20 has a pair of recessed portions 24 that are opened frontward and inward, that is, toward the accommodation container 17, to be recessed to the inside of the housing unit 12 as approaching the lower end. Further, the upper end of the opening/closing cover 18, which is on both ends of the accommodation container 17 attached to the housing unit 12 in the width direction X and is at the closing position, is exposed through the recessed portions 24.

Figure 2:
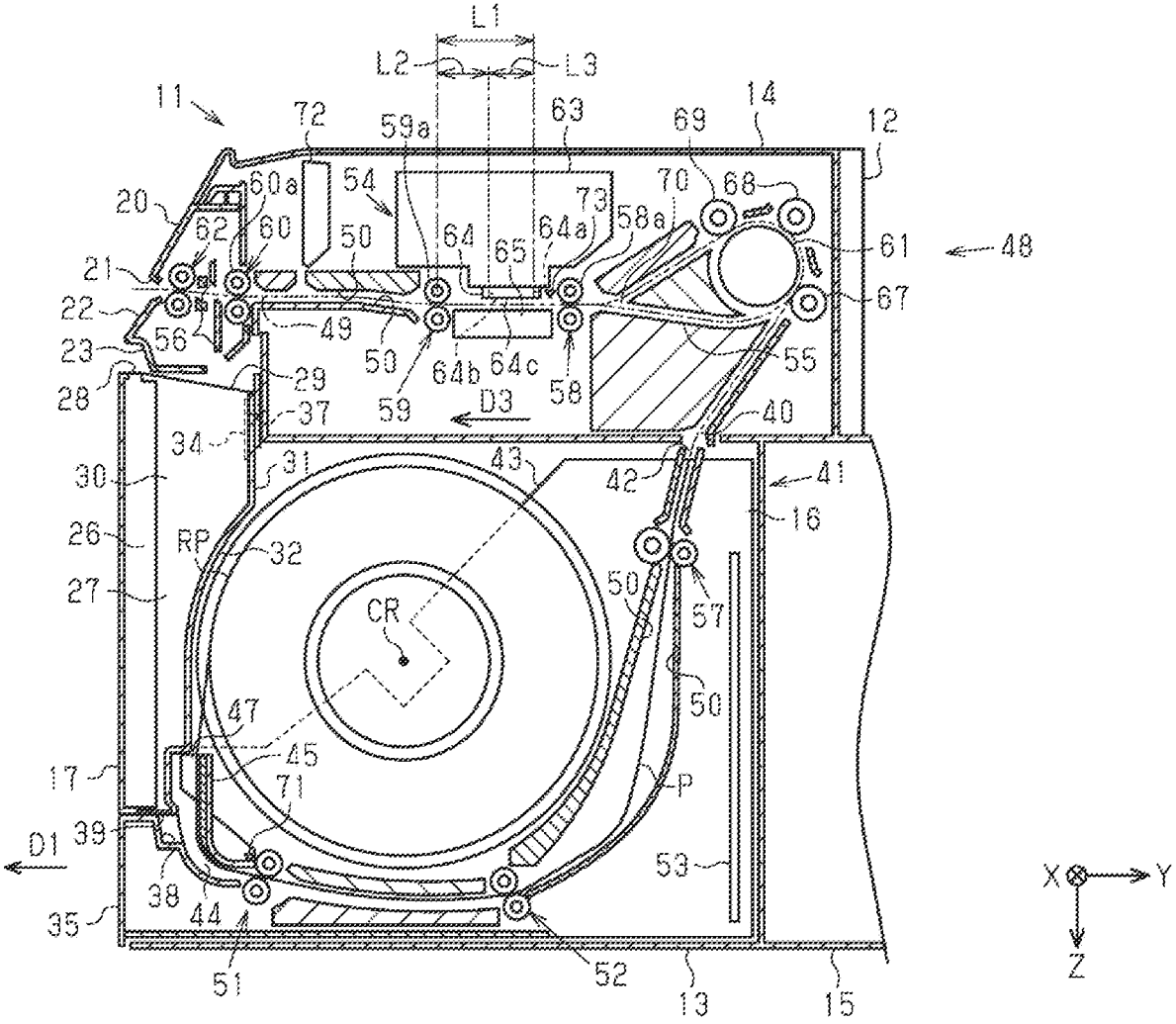
FIG. 2 is a schematic cross-sectional view illustrating a standby state of a medium before the printer starts an operation.

As illustrated in FIG. 2, the printer 11 includes a feeding unit 41 that transports, to the second accommodation part 14, the leading end of the medium P fed out from a state of being wound up in a roll shape accommodated in the first accommodation part 13. The feeding unit 41 includes a roller group including transport roller pairs 51, 52, and 57 and a plurality of transport surfaces 50 in a transport path 49 from the roll body RP to an outlet 42 of the first accommodation part 13. The transport roller pairs 51, 52, and 57 have a configuration of being rotatable in synchronization and rotatable in both forward and backward directions. Specifically, in this configuration, the elongated medium P can be fed out from the roll body RP, and the elongated medium P that is fed out can be re-wound back to the roll body RP. In the following description, the "elongated medium P" is described as the "medium P" in some cases.

The drawer unit 16 of the first accommodation part 13 supports the transport roller pairs 51, 52, and 57 that transport the medium P, which is fed out from the roll body RP, in a transport direction toward the second accommodation part 14. Note that the front plate portion 35 and the transport roller pairs 51 and 52 are arranged below a rotation center CR of the roll body RP in the vertical direction Z.

As illustrated in FIG. 2, in the second accommodation part 14, the printer 11 includes a transport unit 48 that transports the medium P, a printing unit 54 that performs printing on the transported medium P by jetting ink being one example of liquid, a cutting unit 56 that cuts the medium P on which printing is performed by the printing unit 54 in the housing unit 12, and a control unit 53 that controls the transport unit 48, the printing unit 54, and the cutting unit 56. The printing unit 54 of the present exemplary embodiment is an ink-jet head.

The transport unit 48 transports the medium P, which is fed out from a state of being wound up in a roll shape, in the transport direction D3. The transport unit 48 includes a roller group including a second nipping roller pair 58, a first nipping roller pair 59, a transport roller pair 60, an intermediation roller 61, pinch rollers 67, 68, and 69, and a discharge roller pair 62, and the plurality of transport surfaces 50 in the transport path 49 from an inlet 40 of the second accommodation part 14 to the discharge port 21.

In the first accommodation part 13 and the second accommodation part 14, the transport surfaces 50 are arranged both sides of the transport path 49, and angles of the transport surfaces 50 vary in accordance with positions in the transport path 49. A direction along the transport path 49 and a direction in which the medium P is transported when printing is performed on the medium P are also referred to as a transport direction D3. The transport direction D3 is a direction in which the medium P is transported along the transport path 49, and varies in accordance with positions in the transport path 49.

The medium P that is fed out from a state of being wound up in a roll shape is transported toward the discharge port 21 through which the medium P is discharged. In the transport path 49 in which the medium P is transported, a direction from the discharge port 21 to the roll body RP is referred to as an upstream direction, and a direction from the roll body RP to the discharge port 21 is referred to as a downstream direction.

The second nipping roller pair 58, the first nipping roller pair 59, and the transport roller pair 60 have a configuration of rotating in synchronization and rotating in both forward and backward directions. Specifically, in this configuration, the medium P can be transported downstream when printing is to be performed on the medium P, and the medium P after printing can be transported upstream.

In the present exemplary embodiment, the second nipping roller pair 58 includes a second nipping roller 58*a*. The second nipping roller 58*a* nips the medium P with the other roller constituting the second nipping roller pair 58. The first nipping roller pair 59 includes a first nipping roller 59*a*. The first nipping roller 59*a* nips the medium P with the other roller constituting the first nipping roller pair 59. The transport roller pair 60 includes a transport roller 60*a*. The transport roller 60*a* nips the medium P with the other roller constituting the transport roller pair 60. Note that, in the present exemplary embodiment, each of the second nipping roller 58*a*, the first nipping roller 59*a*, and the transport roller 60*a* nips the medium P with a roller, but may have a configuration of nipping the medium P with the transport surfaces 50.

Meanwhile, independently from the second nipping roller pair 58, the first nipping roller pair 59, and the transport roller pair 60, the intermediation roller 61 solely rotates in both forward and backward directions. Specifically, when printing is performed on the medium P fed out from the roll body RP or cutform paper CP described later, the medium P or the cutform paper CP described later is transported in a counter-clockwise direction about the intermediation roller 61. Further, when the medium P fed out from the roll body RP is re-wound back to the roll body RP, the medium P is transported in a clockwise direction about the intermediation roller 61. Thus, at a branched path 70 upstream of the second nipping roller pair 58, the transport surfaces 50 of the branched path 70 are formed into such shapes that, when the cutform paper CP described later is transported from the downstream, the leading end is transported to a switchback transport path 55 below the intermediation roller 61.

As illustrated in FIG. 2, the printer 11 includes the printing unit 54 and a support unit 65. The printing unit 54 includes a carriage 63 that is reciprocally movable in the width direction X, and a liquid jetting unit 64 arranged in a lower part of the carriage 63. The support unit 65 supports the medium P transported by the transport unit 48.

The liquid jetting unit 64 includes a plurality of nozzles that jet liquid. In FIG. 2, among the plurality of nozzles, positions of a most upstream nozzle 64*a* and a most downstream nozzle 64*b* are illustrated. A nozzle surface 64*c* corresponds to a surface range of a surface on which the nozzles are arranged in the liquid jetting unit 64. The surface range has an inter-nozzle distance L3 from the most upstream nozzle 64*a* to the most downstream nozzle 64*b*, which is illustrated in FIG. 2. The printing unit 54 has a configuration of being movable to a position at which the nozzle surface 64*c* does not face the medium P transported by the transport unit 48, by reciprocally moving in the width direction X.

The printing unit 54 performs printing on the elongated medium P that is fed out from the roll body RP obtained by winding up the elongated medium P. The printer 11 is configured to perform simplex printing and duplex printing. During simplex printing, printing is performed only on a first surface of the medium P, and a printed object subjected to printing only on the first surface is output. During duplex printing, printing is performed on the first surface of the medium P and a second surface being an opposite surface thereof, and a printed object subjected to printing on the first surface and the second surface is output. Note that, in the present exemplary embodiment, with regard to the transport direction D3, a part of the medium P on which printing is performed has the transport direction D3 that is parallel to the Y axis when printing is performed on the medium P.

The medium P has a multi-layer structure including a base material and an ink reception layer. The medium P of the present exemplary embodiment includes an ink reception layer on each of the first surface and the second surface. The ink reception layer is a coating layer formed on the base material in an ink-jet recording medium, for the purpose of absorbing ink and fixing a color material such as dye and pigment. Note that the medium P may have a configuration of including the ink reception layer only on one surface. When the medium P has the ink reception layer, a restriction on a direction in which the medium P can be bent and a degree of the bending is caused to a certain extent. Thus, even when duplex printing is performed, the medium P including the ink reception layer only on one surface may be used.

The leading end of the medium P is a downstream end. Further, the rear end of the medium P is an upstream end. Therefore, in cases of the cutform paper CP described later, a cut piece WP, and a shredded piece SP, a lower end is a leading end, and an upstream end is a rear end.

As illustrated in FIG. 2, at a position between the second nipping roller pair 58 and the liquid jetting unit 64 of the printing unit 54, and in the vicinity of the second nipping roller pair 58, the printer 11 includes a second sensor 73 that detects passing of the medium P or the cutform paper CP described later. The second sensor 73 is arranged in the vicinity of the second nipping roller pair 58, and hence the second sensor 73 detects passing of the leading end of the medium P in a state with less influence of a curl of the medium P. In accordance with a detection result of the second sensor 73, the control unit 53 controls the transport unit 48.

In the present exemplary embodiment, the control unit 53 executes duplex printing by causing the printing unit 54 to perform printing on the first surface of the medium P and causing the printing unit 54 to perform printing on the second surface of the medium P after printing is performed on the first surface. In this case, the first surface is an outer circumferential surface, and the second surface is an inner circumferential surface. Specifically, with respect to the medium P or the cutform paper CP described later, which has a leading end positioned at a printing start position P1, the control unit 53 causes the printing unit 54 to perform printing on the first surface as outer circumferential surface printing, and to perform printing on the first surface as inner circumferential surface printing.

When the printer 11 starts printing on the first surface, the printing unit 54 is at the position at which the nozzle surface 64*c* does not face the medium P transported by the transport unit 48. In the present exemplary embodiment, as printing on the first surface, printing is performed on the outer circumferential surface of the roll body RP, which is positioned on the outside. When the medium P is supported by the support unit 65, the first surface of the medium P, which is the outer circumferential surface of the roll body RP, faces upward in the vertical direction Z. In other words, the first surface of the medium P supported by the support unit 65 faces the printing unit 54. Therefore, when the nozzle surface 64*c* in the printing unit 54 is at the position facing the medium P, the first surface of the roll body RP faces the nozzle surface 64*c*. Specifically, the end of the medium P is to be curled toward the support unit 65 due to curling of the roll body RP.

Figure 3:
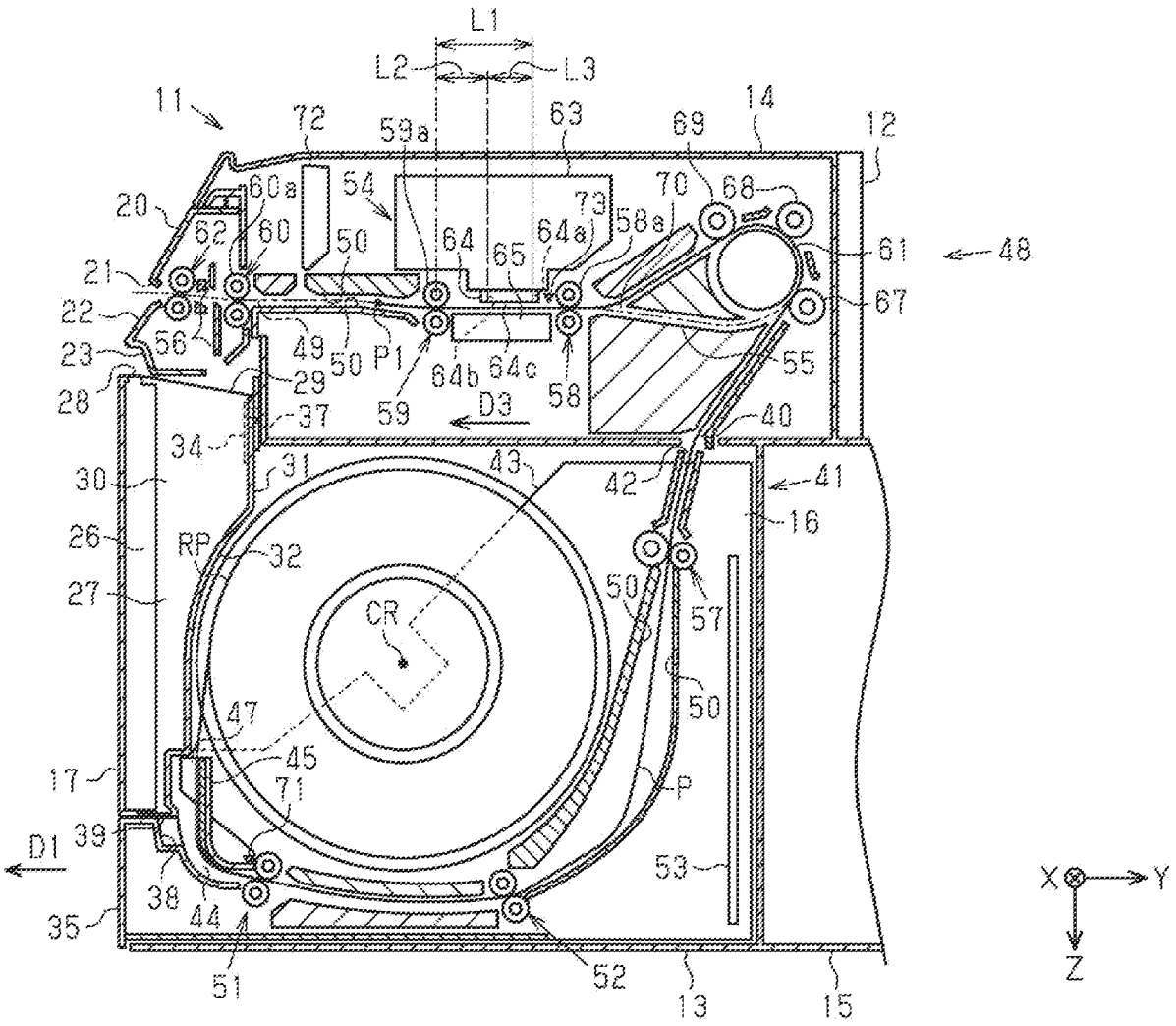
FIG. 3 is a schematic cross-sectional view illustrating a nipped state of a first surface of the medium subjected to duplex printing.

As illustrated in FIG. 3, before starting printing on the first surface, the control unit 53 positions the leading end of the medium P at the printing start position P1. The printing start position P1 is present downstream of a position facing the most downstream nozzle 64*b* of the nozzle surface 64*c*, in the transport direction D3. Note that FIG. 3 illustrates the transport path 49 through which the medium P passes. In the path, the solid part indicates a part in which the medium P is actually present, and the two-dot chain part indicates a part in which the medium P is not actually present.

More specifically, a detected position at which the second sensor 73 detects passing of the leading end of the medium P and a transport amount M corresponding to a length from the printing start position P1 are set in advance. After the second sensor 73 detects passing of the leading end of the medium P, the control unit 53 transports the medium P by the set transport amount. In this manner, the leading end of the medium P is positioned at the printing start position P1.

The length of the medium P downstream of the second nipping roller pair 58 when the second sensor 73 detects passing of the leading end of the medium P varies in accordance with curling orientation of the medium P or a curl amount of the medium P. Thus, when the control unit 53 transports the medium P by the transport amount M after the second sensor 73 detects passing of the leading end of the medium P, a position of the leading end of the medium P at the time of completion of transporting by the transport amount M differs in accordance with curling orientation of the medium P or a curl amount of the medium P. Therefore, the transport amount M is preferably set to such transport amount M that enables the leading end of the medium P to be positioned at the printing start position P1 regardless of curling orientation of the medium P or a curling amount of the medium P.

The second nipping roller pair 58 nips the medium P at a second nipping position upstream of the printing unit 54 in the transport direction D3 in which the medium P is transported. Further, the first nipping roller pair 59 nips the medium P at a first nipping position downstream of the printing unit 54 in the transport direction D3 in which the medium P is transported.

As illustrated in FIG. 3, in the present exemplary embodiment, the printing start position P1 is a position downstream of the first nipping position in the transport direction D3, at which the first nipping roller pair 59 nips the medium P. Therefore, before the printing unit 54 starts printing, the medium P is in a nipped state of being nipped by the first nipping roller pair 59 and being nipped by the second nipping roller pair 58. When the medium P is in the nipped state, the control unit 53 causes the printing unit 54 to start printing on the first surface of the medium P.

The printer 11 may include a heater 72 at a position downstream of the printing unit 54. For example, the heater 72 is an infrared ray heater. In the infrared ray heater, a heat generating member emits radiant heat being heat of an infrared ray or the like. The printer 11 causes the infrared ray heater to dry the surface of the medium P having a moisture content increased due to printing performed by jetting liquid onto the surface. In the present exemplary embodiment, the heater 72 is provided between the first nipping roller pair 59 and the transport roller pair 60.

Figure 4:
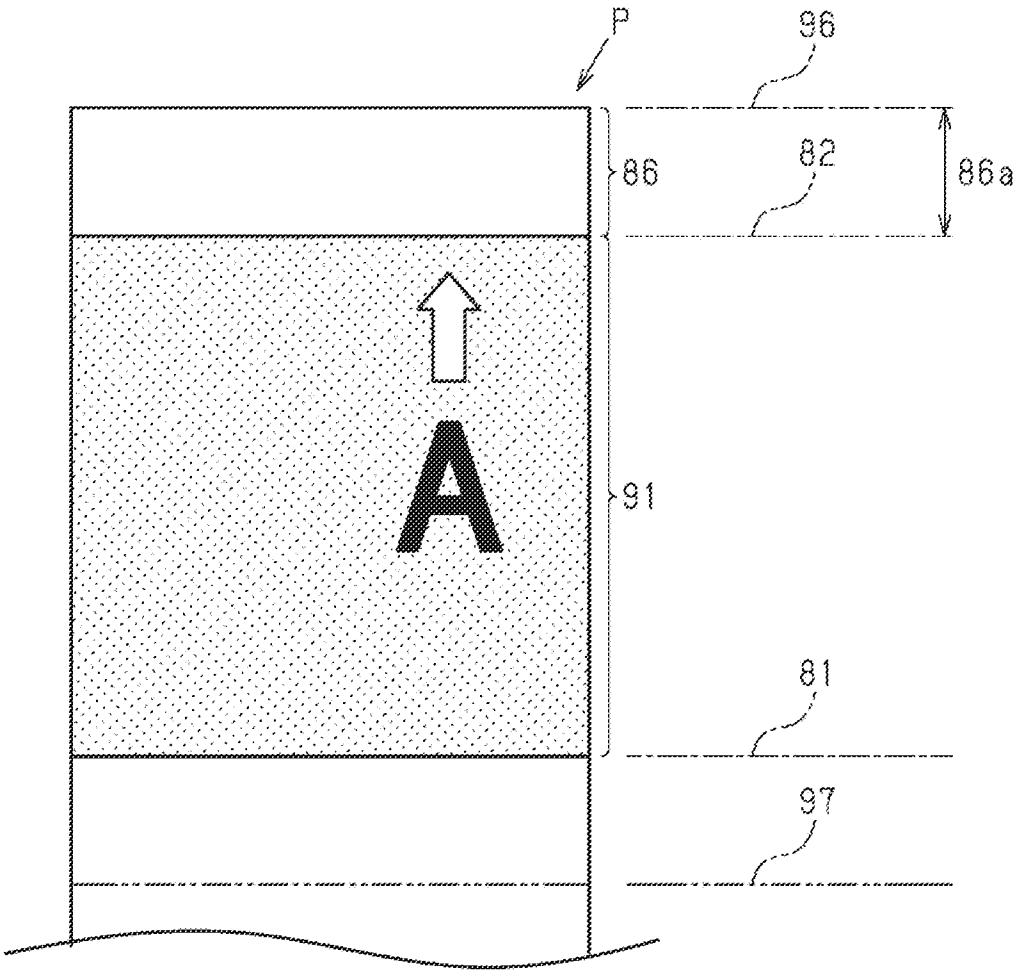
FIG. 4 is a schematic view illustrating a leading end margin and a printing region after printing is performed on the first surface of the medium subjected to duplex printing.

FIG. 4 illustrates a printing region and a margin on the medium P after printing is performed on the first surface of the medium P. As illustrated in FIG. 4, the first surface of the medium P has a leading end margin 86 in a part between a reference end 96 and a first printing region 91. Note that, in the present exemplary embodiment, the reference end 96 is the leading end of the elongated medium P unwound from the roll body RP. Further, the reference end 96 is an end of a leading end of the roll body RP, which is formed when the cutform paper CP described later is cut from the roll body RP in a previous operation of outputting a printed object OP.

The first printing region 91 has a first end 81 and a second end 82. The first end 81 is an upstream end when printing is performed on the first surface. The second end 82 is a downstream end when printing is performed on the first surface. In printing on the first surface, the control unit 53 causes the printing unit 54 to form the first printing region 91 having the second end 82 at the position away from the reference end 96 of the medium P.

The reference end 96 being the leading end in printing on the first surface is the rear end of the medium P in printing on the second surface. The control unit 53 causes the printing unit 54 to form the first printing region 91 in such a way that the distance between the second end 82 and the reference end 96 is greater than the inter-nozzle distance L3. Further, the control unit 53 may cause the printing unit 54 to form the first printing region 91 in such a way that the distance between the second end 82 and the reference end 96 is greater than the distance between the position of the second nipping roller pair 58 and the most downstream nozzle 64*b* in the transport direction D3.

Figure 5:
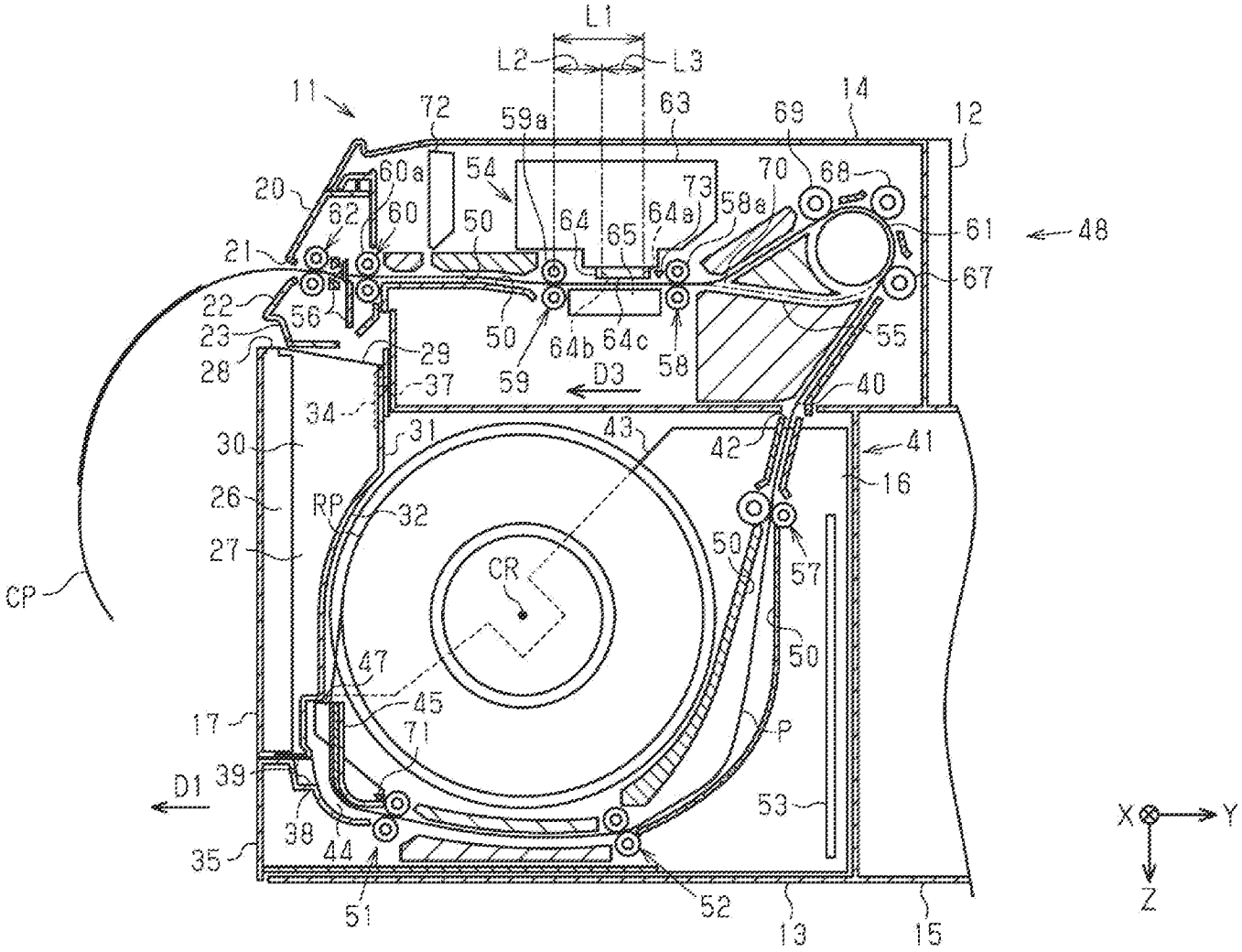
FIG. 5 is a schematic cross-sectional view illustrating a cut state of a rear end on the first surface of the medium subjected to duplex printing.

As illustrated in FIG. 5, the cutting unit 56 includes a lower blade being a fixed blade and an upper blade being a movable blade. The lower blade being a fixed blade is fixed in such a way that an edge thereof is positioned on the +Z side with respect to a position of the transport surface 50 on the +Z side in the transport path 49. The upper blade being a movable blade moves between a retraction position illustrated in FIG. 3 and a cutting position. At the retraction position, the edge of the upper blade is positioned on the −Z side with respect to the position of the transport surface 50 on the −Z side in the transport path 49. At the cutting position, the edge of the upper blade is positioned on the +Z side with respect to the edge of the lower blade. When the upper blade is at the retraction position illustrated in FIG. 3, the medium P passes between the lower blade and the upper blade. In a state of positioning the medium P below the upper blade at the retraction position, the control unit 53 causes the upper blade to move to the cutting position and to cut the medium P. Note that the cutting unit 56 of the present exemplary embodiment has a configuration in which the upper blade being a movable blade moves from the retraction position to the cutting position, and may alternatively have a configuration in which the upper blade having an edge positioned on the +X side with respect to the edge of the lower blade moves in the width direction X and cuts the medium P.

The discharge roller pair 62 and the discharge port 21 are arranged downstream of the cutting unit 56. The discharge roller pair 62 is driven by a transport motor independent from a driving source that drives the other roller pairs. Thus, the discharge roller pair 62 solely rotates in both forward and backward directions and stops.

Figure 6:
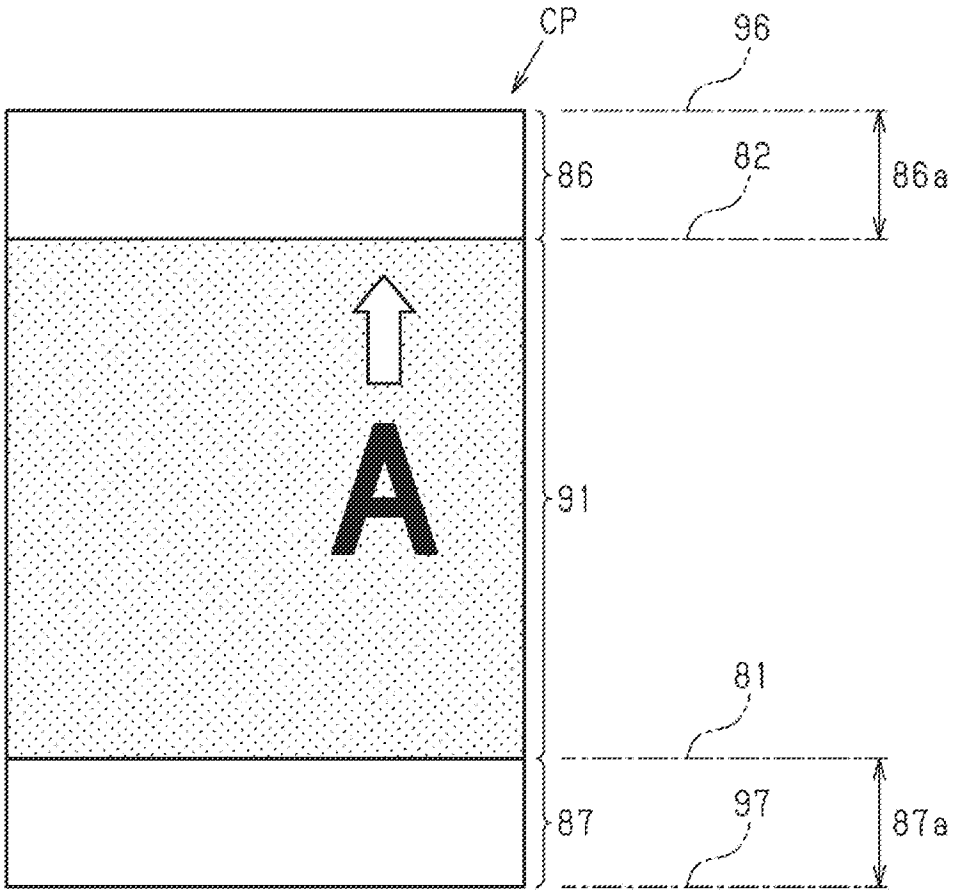
FIG. 6 is a schematic view illustrating the leading end margin, the printing region, and a rear end margin after cutting the rear end on the first surface of the medium subjected to duplex printing.

The cutform paper CP illustrated in FIG. 6 is a part cut off from the roll body RP when the cutting unit 56 cuts the medium P on which the printing unit 54 performs printing. Specifically, the cutform paper CP is included in the medium P. Thus, hereinafter, the cutform paper CP may be replaced with the "medium P".

After causing the printing unit 54 to perform printing on the first surface of the medium P, the control unit 53 causes the cutting unit 56 to cut the medium P at a cut position 97 positioned upstream of the first end 81 being an upstream end of the first printing region 91 that is formed on the first surface by the printing unit 54. In this manner, the rear end of the cutform paper CP, which corresponds to the cut position 97, and the first end 81 are away from each other. Thus, a rear end margin 87 is formed on the cutform paper CP. Specifically, a region between the first end 81 and the cut position 97 on the first surface of the medium P is the rear end margin.

Figure 7:
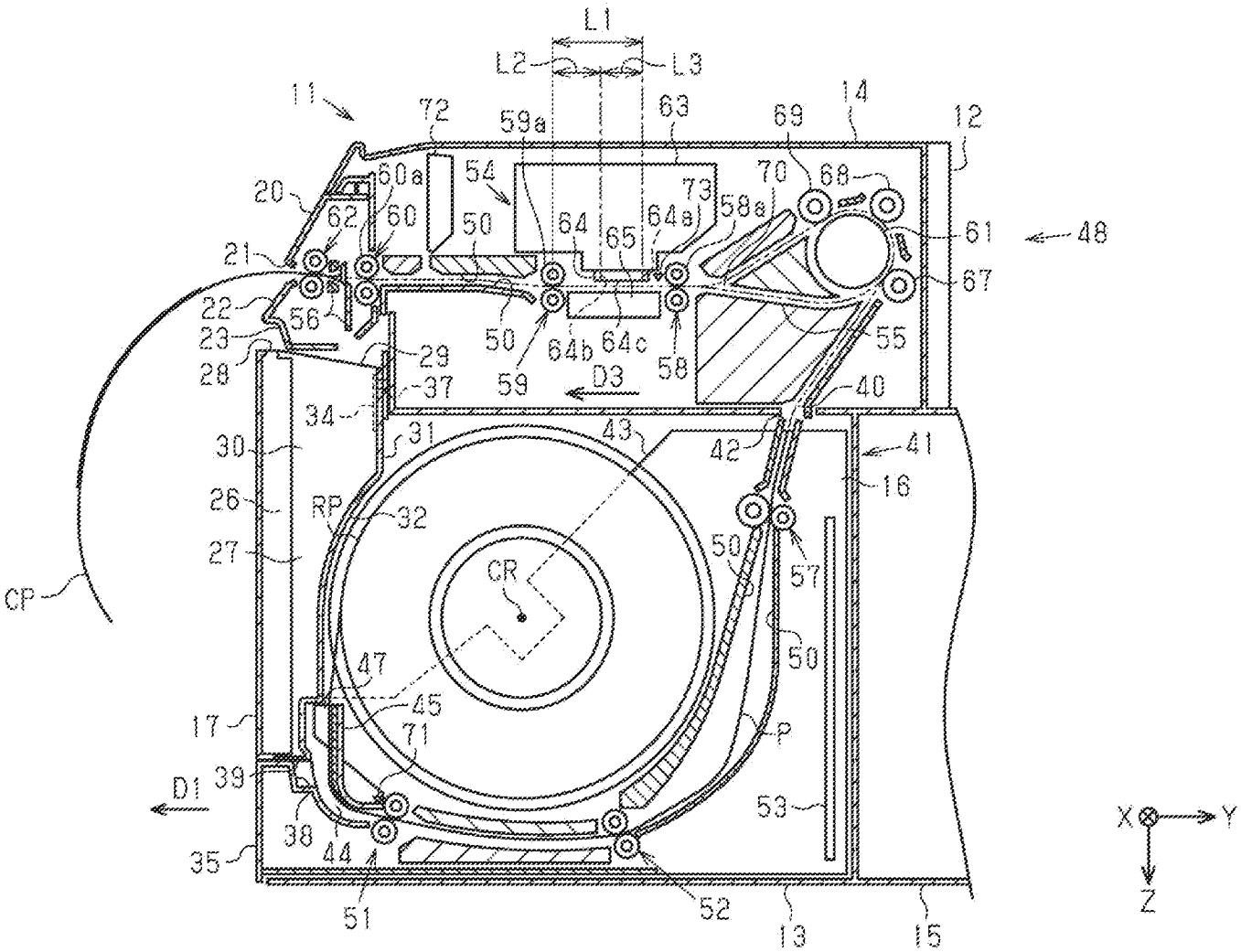
FIG. 7 is a schematic cross-sectional view illustrating a state in which a leading end of a roll body returns to a standby position after cutting the rear end on the first surface of the medium subjected to duplex printing.

FIG. 7 illustrates a state of the medium P after the cutting unit 56 performs cutting at the cut position 97. As illustrated in FIG. 7, of the medium P after the cutting unit 56 performs cutting, a part including the roll body RP is transported in a clockwise direction about the intermediation roller 61, and is re-wound back to the roll body RP to a position of being nipped between the transport roller pair 57 and a position at which the leading end is accommodated in the first accommodation part 13.

During duplex printing, after the medium P is cut at the cut position 97, the control unit 53 causes the discharge roller pair 62 to transport the cutform paper CP, which is cut off from the roll body RP, upstream. Further, the transport roller pair 60, the first nipping roller pair 59, and the second nipping roller pair 58 transport the cutform paper CP toward the intermediation roller 61 that reverses the cutform paper CP inside out.

Figure 8:
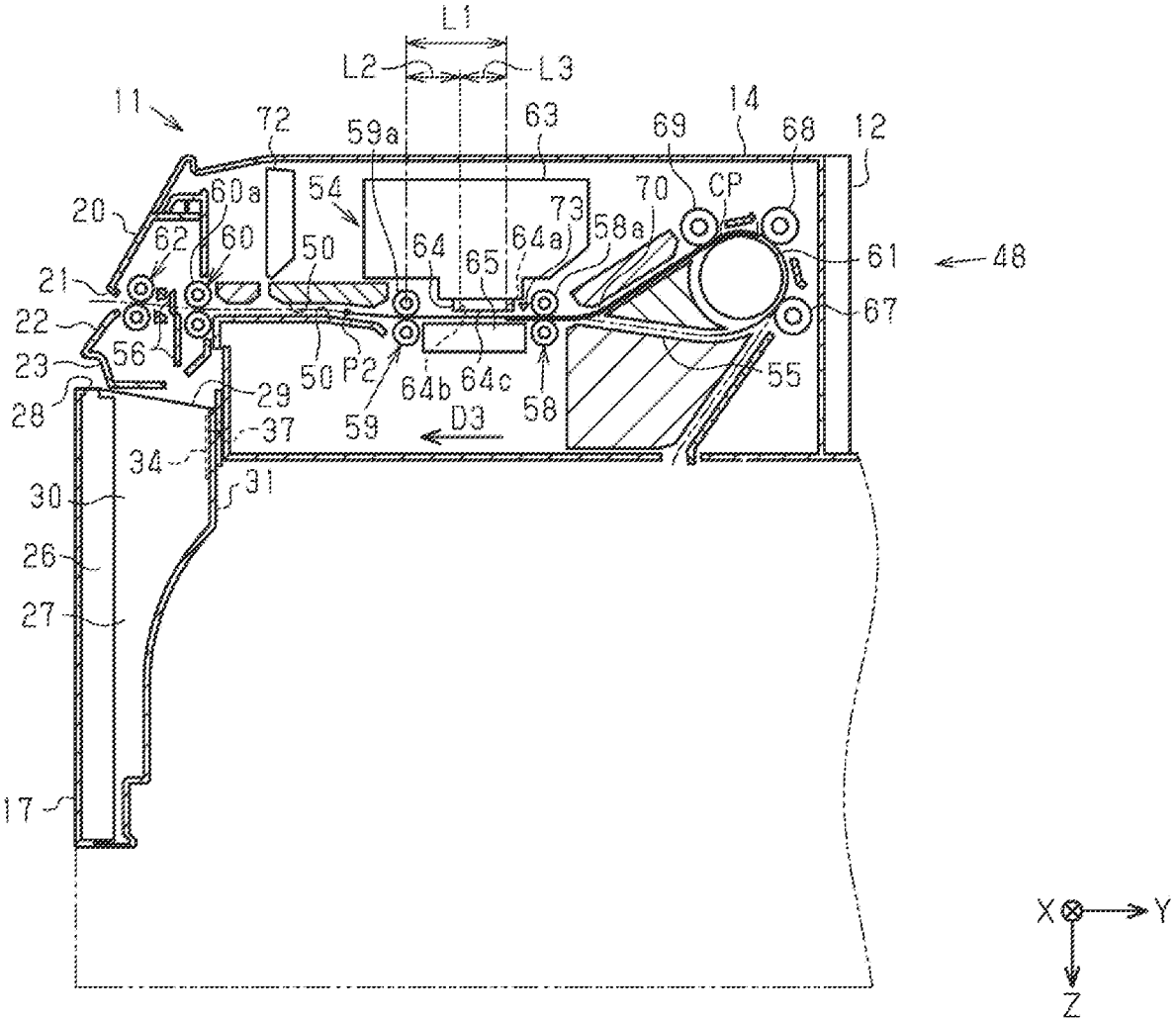
FIG. 8 is a schematic cross-sectional view illustrating a nipped state of a second surface during duplex printing.

FIG. 8 illustrates a state in which the cut position 97 is at a printing start position P2 described later. In the present exemplary embodiment, the cutting unit 56 cuts the medium P in such a way that the length of the cutform paper CP in the transport direction D3 is shorter than a length of a transport path extending from the second nipping roller pair 58, going around the intermediation roller 61, and then arriving at the second nipping roller pair 58 again. In this manner, the second nipping roller pair 58 can transport the cutform paper CP upstream, and can transport the cutform paper CP, which is reversed by the intermediation roller 61, downstream.

The cutform paper CP that is transported upstream is transported in the switchback transport path 55, is nipped between the intermediation roller 61, and the pinch rollers 67, 68, and 69, and is transported in the counter-clockwise direction about the intermediation roller 61. Specifically, the intermediation roller 61 reverses the cutform paper CP inside out, and the cutform paper CP is transported with the reference end 96, which is the leading end at the time of performing printing on the first surface, as a rear end and the cut position 97 as a leading end. The cutform paper CP reversed by the intermediation roller 61 is transported in a state in which the second surface faces upward in the vertical direction Z, in other words, a state in which the second surface faces the printing unit 54. In the present exemplary embodiment, as printing on the second surface, the control unit 53 executes printing on the inner circumferential surface positioned inside of the roll body RP.

The control unit 53 controls the transport unit 48, and thus positions the cut position 97, which corresponds to the leading end of the cutform paper CP, at the printing start position P2. As illustrated in FIG. 8, the printing start position P2 is present downstream of the first nipping position in the transport direction D3, at which the first nipping roller pair 59 nips the medium P. Similarly to the control for positioning the reference end 96 at the printing start position P1, the control unit 53 positions the cut position 97 at the printing start position P2 at the time of performing printing on the first surface. More specifically, after the second sensor 73 detects that the cutform paper CP passes through the cut position 97, the cutform paper CP is transported by a set transport amount. With this, the cut position 97 is positioned at the printing start position P2. The control unit 53 starts printing on the second surface of the cutform paper CP having the cut position 97 positioned at the printing start position P2. In this case, the cutform paper CP is nipped by the second nipping roller pair 58, and is transported by the second nipping roller pair 58. Therefore, the control unit 53 starts printing on the second surface when the cutform paper CP is in the nipped state of being nipped by the first nipping roller pair 59 and nipped by the second nipping roller pair 58.

Figure 9:
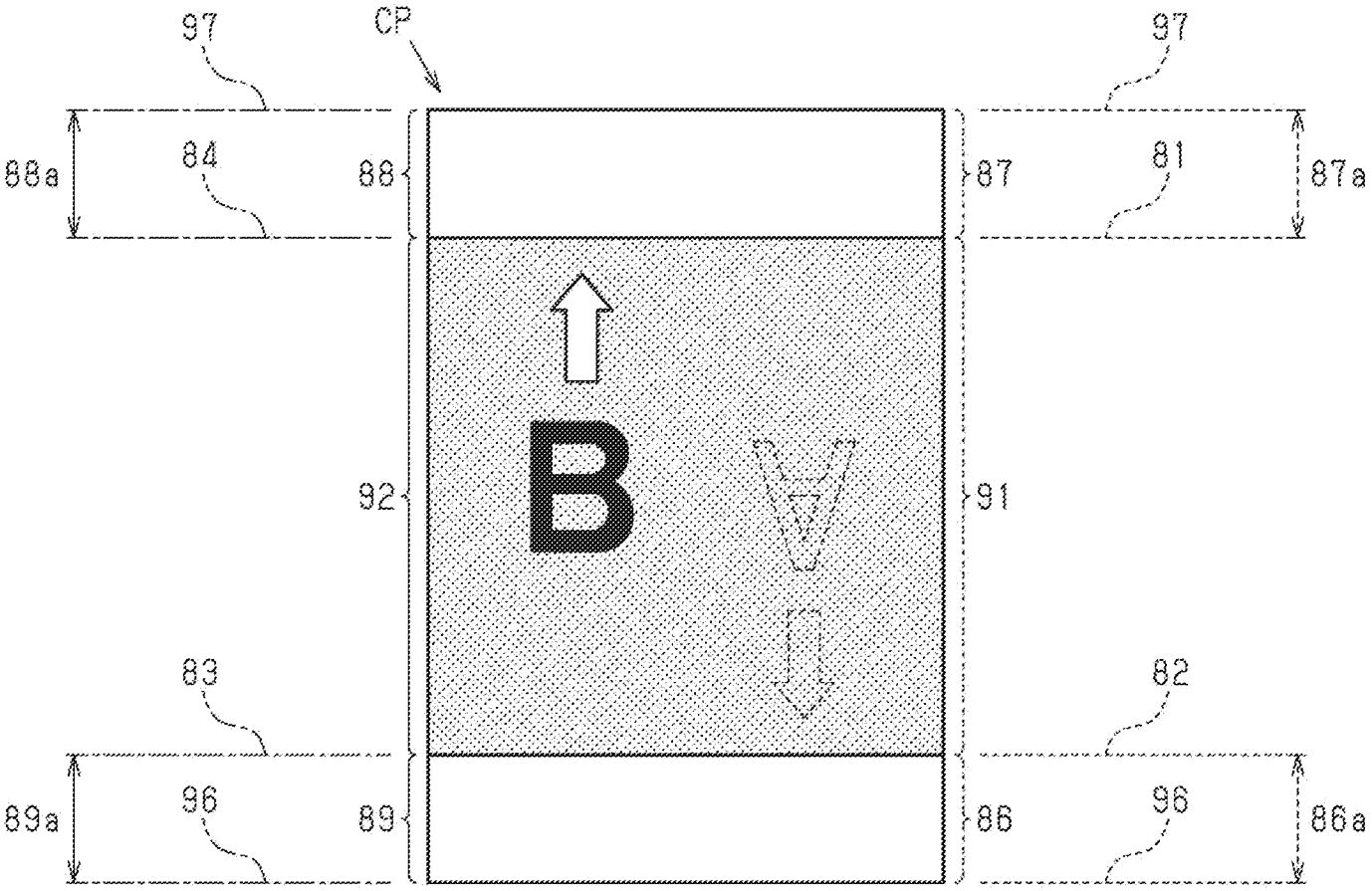
FIG. 9 is a schematic view illustrating a leading end margin, a printing region, and a rear end margin after printing is performed on the second surface of the medium subjected to duplex printing.

The rear end margin 87 illustrated in FIG. 9 is the region between the cut position 97 and the first end 81. Therefore, the margin distance 87*a* of the rear end margin 87, which is a dimension in the transport direction D3, is the distance between the first end and the cut position 97 in the transport direction D3. In printing on the second surface, the control unit 53 causes the printing unit 54 to form the second printing region 92. From the time of forming the first printing region 91 to the time of forming the second printing region, the cutform paper CP is reversed in the transport direction D3. Thus, in printing on the second surface, a leading end margin 88 between the cut position 97, which corresponds to the leading end of the cutform paper CP, and the second printing region 92 is positioned at a position corresponding to the rear end margin 87. Similarly, in printing on the second surface, a rear end margin 89 between the reference end 96, which corresponds to the rear end of the cutform paper CP, and the second printing region 92 is positioned at a position corresponding to the leading end margin 86. Further, as illustrated in FIG. 9, when printing on the second surface is started from the fourth end 84 of the second printing region 92 of the cutform paper CP, the control unit 53 sets the position of the second printing region in such a way that the margin distance 88*a* and the margin distance 87*a* are the same distance.

In printing on the second surface in the present exemplary embodiment, the end of the medium P is curled toward the liquid jetting unit 64 due to curling of the roll body RP, and a deformation amount in the Z direction is largest at the leading end and the rear end of the medium P. The leading end of the medium P in printing on the second surface corresponds to the cut position 97 in printing on the first surface.

The control unit 53 configures the margin distance 88*a* being a distance in the transport direction D3 between the fourth end 84 of the second printing region 92 and the cut position 97, which is illustrated in FIG. 9, to be greater than the inter-nozzle distance L3 being a distance in the transport direction between the most upstream nozzle 64*a* and the most downstream nozzle 64*b*, which is illustrated in FIG. 8. As illustrated in FIG. 9, even when the fourth end 84 is formed by jetting liquid from any one of the nozzles from the most downstream nozzle 64*b* illustrated in FIG. 8 to the most upstream nozzle 64*a* illustrated in FIG. 8, the fourth end 84 is formed at the position corresponding to the position of the first end 81 on the inside and the outside of the medium.

As illustrated in FIG. 8, in the present exemplary embodiment, the cut position 97 being the leading end of the cutform paper CP is transported to the printing start position P2 being a position downstream of the first nipping position at which the first nipping roller pair 59 nips the medium P. More specifically, similarly to the control for transporting the reference end 96 to printing start position P1 in printing on the first surface, after the second sensor 73 detects that the cutform paper CP passes through the cut position 97, the medium P is transported by a set transport amount. With this, the control unit 53 causes transportation of the cut position 97 of the cutform paper CP to the printing start position P2. When the first printing region 91 is formed, and the cutform paper CP cut at the cut position 97 is in the nipped state, the control unit 53 causes the printing unit 54 to start printing on the second surface of the cutform paper CP. As printing on the second surface of the cutform paper CP, the control unit 53 causes the printing unit 54 to form the second printing region 92, which is illustrated in FIG. 9, on the cutform paper CP.

Further, in the present exemplary embodiment, the margin distance 87*a* illustrated in FIG. 9 is greater than the most upstream nozzle distance L1 illustrated in FIG. 8. The most upstream nozzle distance L1 is a distance in the transport direction D3 between the most upstream nozzle 64*a* of the printing unit 54 and the position at which the first nipping roller pair 59 nips the cutform paper CP. As illustrated in FIG. 9, the margin distance 87*a* is a distance in the transport direction between the first end 81 of the first printing region 91 and the cut position 97. The margin distance 87*a* is set in this manner. Thus, the control unit 53 can cause the first nipping roller pair 59 to nip the cutform paper CP while positioning the first end 81 upstream of the most upstream nozzle 64*a*. Therefore, in a state in which the cutform paper CP is nipped by the first nipping roller pair 59, liquid can be jetted from any one of the nozzles from the most upstream nozzle 64*a* to the most downstream nozzle 64*b* onto the position corresponding to the first end 81. Printing on the second surface is terminated in a state in which the medium P is nipped by the first nipping roller pair 59 downstream of the printing unit 54 and is nipped by the second nipping roller pair 58 upstream of the printing unit 54.

When the printer 11 starts printing on the second surface, the printing unit 54 is at the position at which the nozzle surface 64*c* does not face the medium P transported by the transport unit 48. In the present exemplary embodiment, as printing on the second surface, printing is performed on the inner circumferential surface being an inner surface of the roll body RP. When the medium P is supported by the support unit 65, the inner circumferential surface of the roll body RP faces upward in the vertical direction Z. In other words, the second surface of the medium P supported by the support unit 65 faces the printing unit 54. Therefore, when the nozzle surface 64*c* in the printing unit 54 is at the position facing the medium P, the second surface after printing is performed on the first surface faces the nozzle surface 64*c*.

In the present exemplary embodiment, the control unit 53 executes duplex printing by causing the printing unit 54 to perform printing on the first surface of the medium P and causing the printing unit 54 to perform printing on the second surface of the medium P after printing is performed on the first surface. In this case, printing is performed on an outer circumferential surface of the roll body RP as the first surface, and printing is performed on an inner circumferential surface of the roll body RP as the second surface.

In printing on the second surface, the end of the cutform paper CP is deformed toward the liquid jetting unit 64 due to curling of the roll body RP. A deformation amount in the Z direction is largest at the cut position 97 and the reference end 96 of the cutform paper CP. In a state in which the reference end 96 of the medium P is positioned upstream of the most upstream nozzle 64*a* in the transport direction D3, the control unit 53 terminates printing on the second surface that is performed by the printing unit 54. Further, in a state in which the cutform paper CP is nipped by the second nipping roller pair 58, the control unit 53 causes the printing unit 54 to terminate printing on the second surface. Such a configuration may be adopted.

Figure 10:
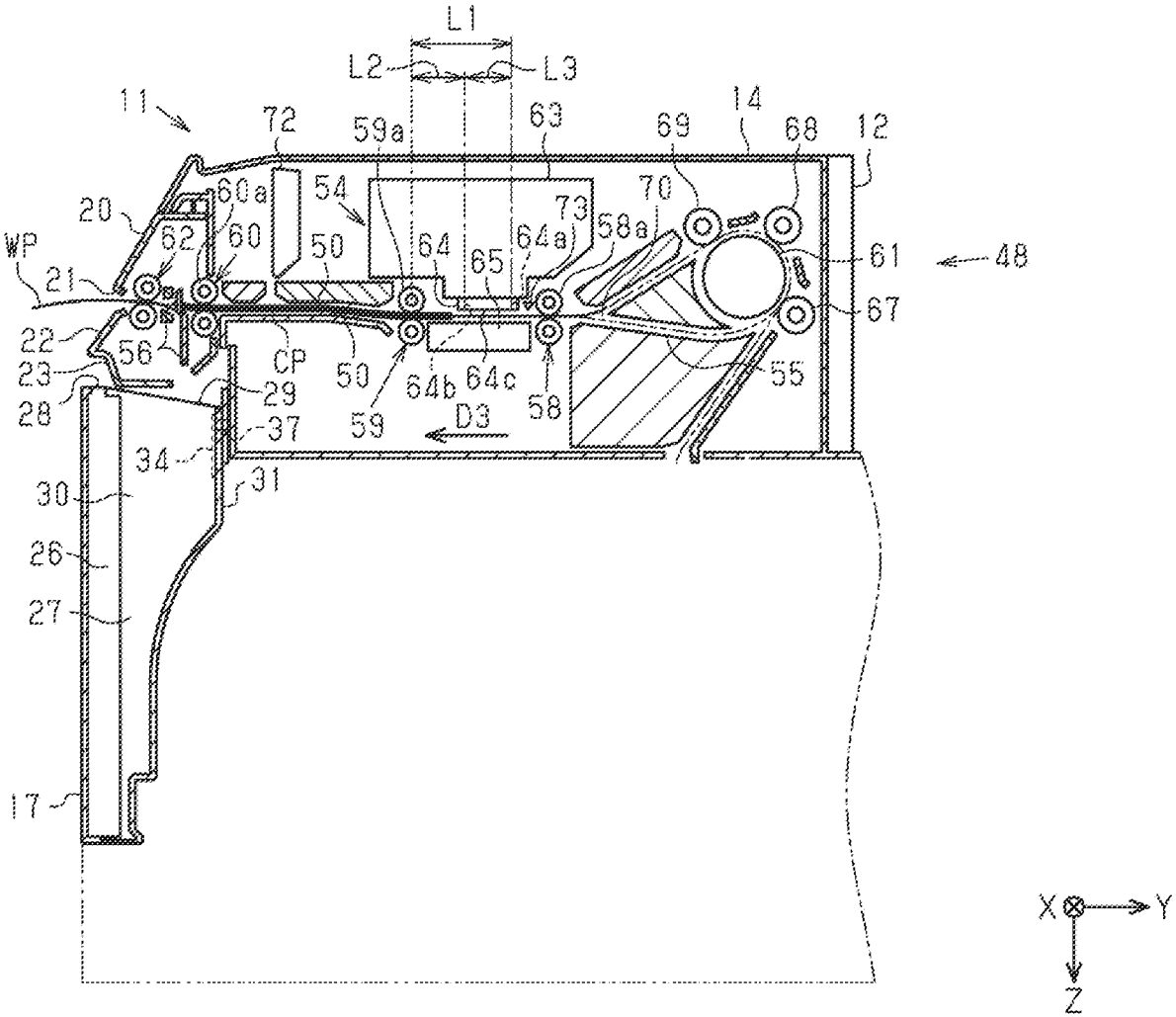
FIG. 10 is a schematic cross-sectional view illustrating a cut state of the leading end margin on the second surface of the medium subjected to duplex printing.

FIG. 10 illustrates a state in which the cutting unit 56 cuts the cutform paper CP at the first end 81. In the present exemplary embodiment, the cutform paper CP cut in FIG. 10 is the cutform paper CP after printing on the second surface is completed.

Figure 11:
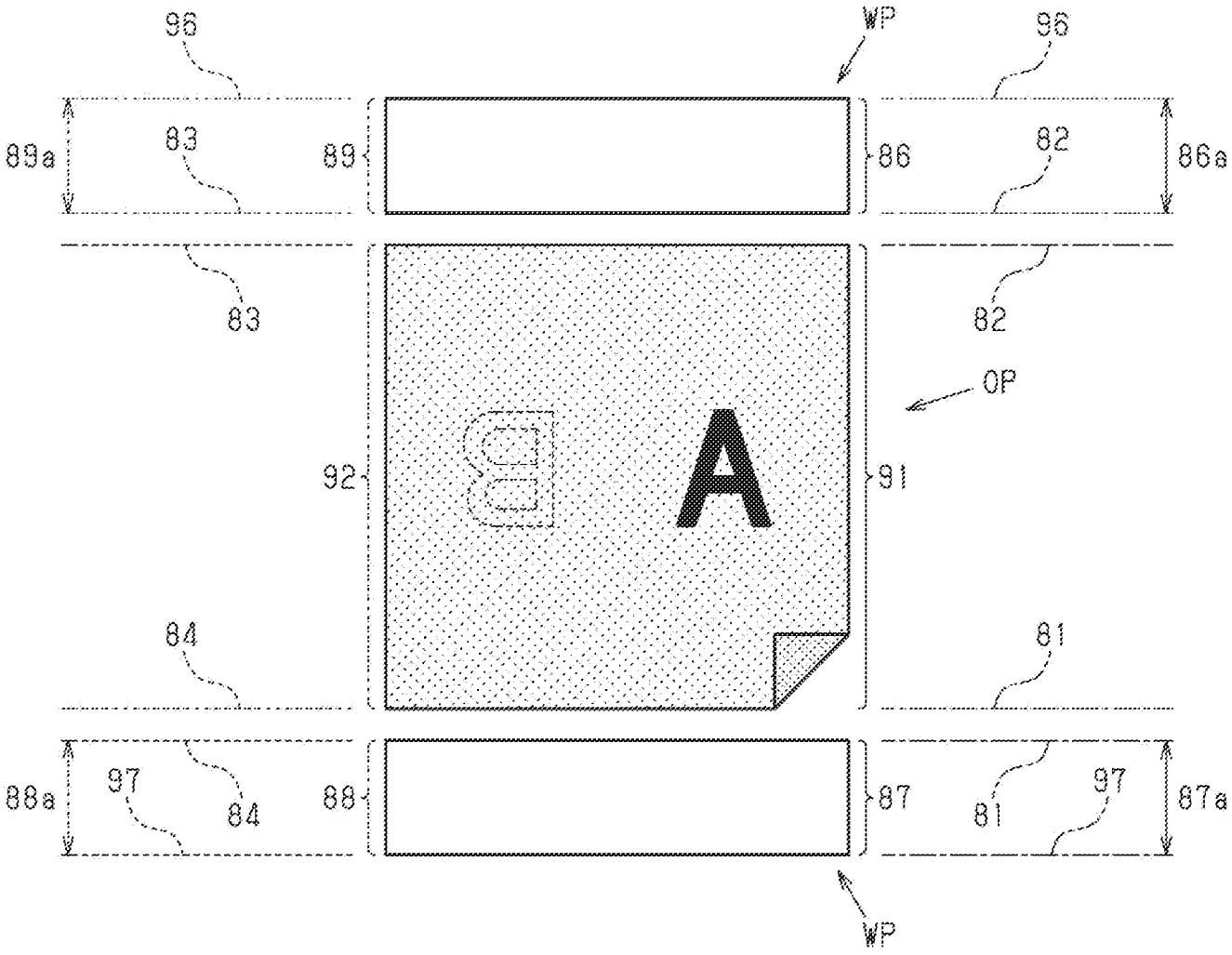
FIG. 11 is a schematic view illustrating a printed object output from the printer and cut pieces accommodated in an accommodation portion.

FIG. 11 illustrates the cutform paper CP after the cutting unit 56 performs cutting. As illustrated in FIG. 11, the control unit 53 causes the cutting unit 56 to cut the cutform paper CP at the first end 81 and the second end 82. The cutform paper CP after cutting is referred to as the cut piece WP. When the cutting unit 56 cuts the cutform paper CP at the first end 81, the cut piece WP corresponding to the rear end margin 87 is cut off from the part in which the first printing region 91 is formed. Further, when the cutting unit 56 cuts the cutform paper CP at the second end 82, the cut piece WP corresponding to the leading end margin 86 is cut off from the part in which the first printing region 91 is formed.

In the present exemplary embodiment, the cutting unit 56 cuts off the cut piece WP corresponding to the rear end margin 87 of the cutform paper CP, which is illustrated in FIG. 11, at a time. After cutting off the cut piece WP corresponding to the rear end margin 87, only the cut piece WP including the first printing region 91 is transported upstream by the transport roller pair 60 that is driven independently from the discharge roller pair 62 that nips the cut piece WP. In this manner, in the transport direction D3, the cut piece WP including the first printing region 91 is separated from the cut piece WP corresponding to the rear end margin 87. When the cut piece WP is transported upstream in an operation of cutting the cut piece WP or the like, which is described later, a risk that the end of the cut piece WP including the first printing region 91 is deformed due to the cut piece WP corresponding to the rear end margin 87 is suppressed.

Figure 12:
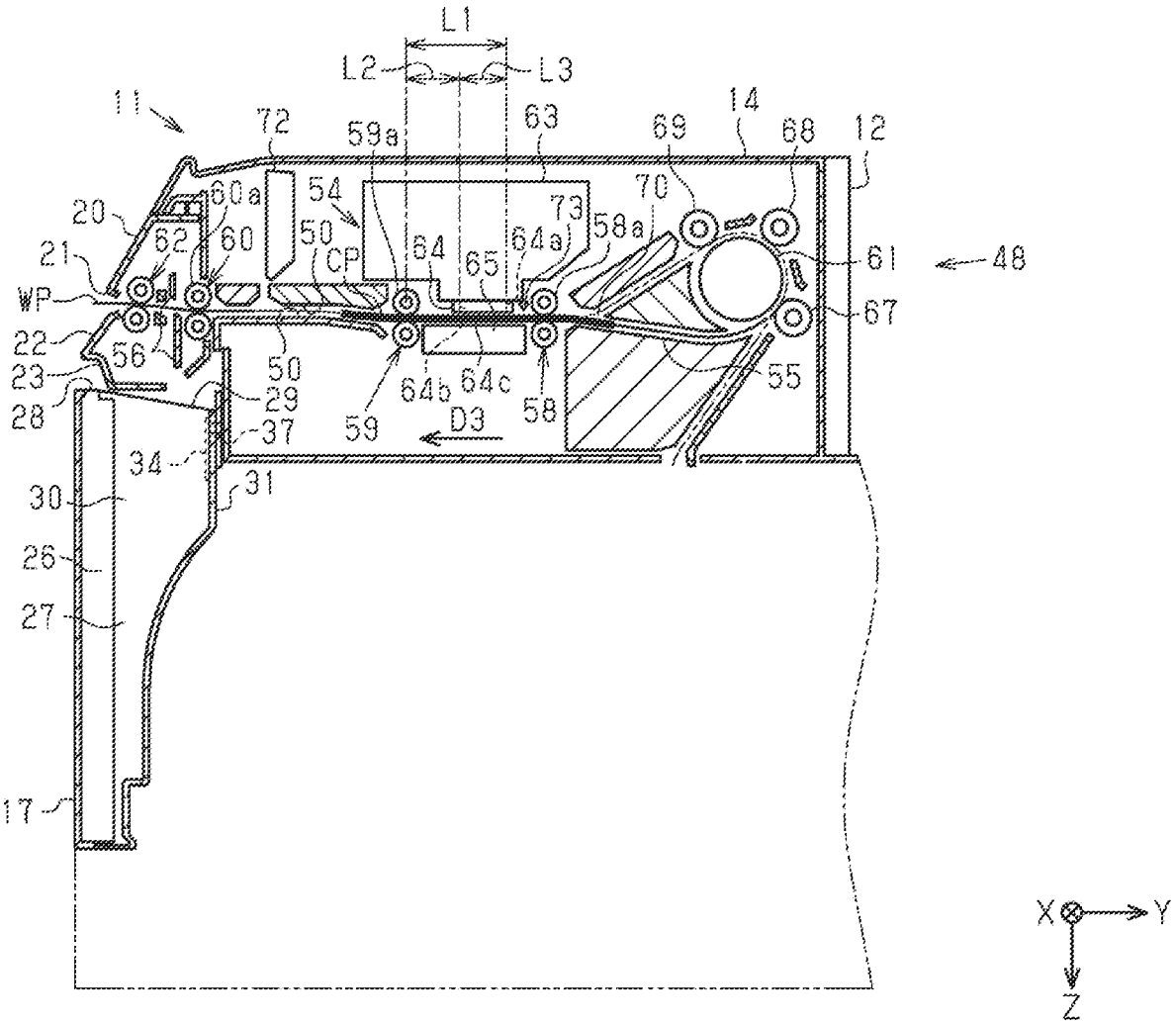
FIG. 12 is a schematic cross-sectional view illustrating a stopping state at a shredding position at which a cut piece on the second surface of the medium subjected to duplex printing is shredded.

The rear end margin 87 illustrated in FIG. 11 may be shredded. As illustrated in FIG. 12, in the present exemplary embodiment, after cutting off the cut piece WP corresponding to the rear end margin 87, the control unit 53 causes the cutting unit 56 to cut the cut piece WP at a position between the cut position 97 being an end of the cut piece WP and the first end 81. In this manner, the cut piece WP corresponding to the rear end margin 87 that is cut off from the cut piece WP including the first printing region 91 is cut at the position between the cut position 97 and the first end 81. With this, the rear end margin 87 is shredded. Note that, of the part that is cut off by cutting the medium P at the position between the cut position 97 and the first end 81, a part in which the first printing region 91 is not formed is referred to as the shredded piece SP. Further, when shredding the rear end margin 87, the cutting unit 56 may cut the cut piece WP at a plurality of positions between the cut position 97 and the first end 81.

Note that, as shredding of the rear end margin 87, the cutting unit 56 may have a configuration of cutting the cutform paper CP at the position between the cut position 97 and the first end 81 before cutting the cutform paper CP at the first end 81. In this case, the cutting unit 56 may also cut the cutform paper CP at the plurality of positions between the cut position 97 and the first end 81.

Figure 13:
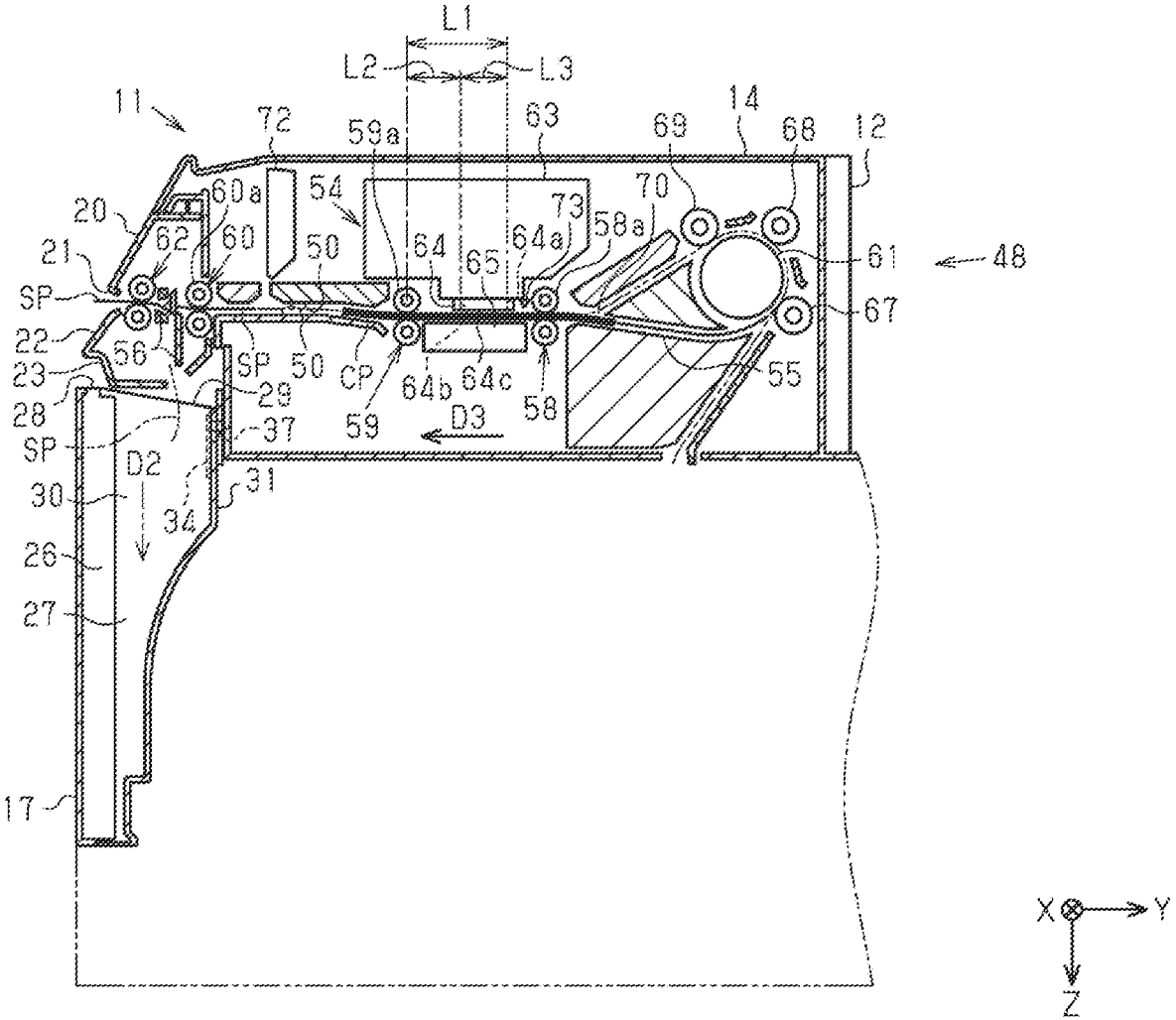
FIG. 13 is a schematic cross-sectional view illustrating a state in which a downstream shredded piece falls down after shredding the leading end margin on the second surface of the medium subjected to duplex printing.

As illustrated in FIG. 13, in the present exemplary embodiment, the control unit 53 causes the cutting unit 56 to cut the cut piece WP in a state in which the transport roller pair 60 and the discharge roller pair 62 nip the cut piece WP corresponding to the rear end margin 87. With this, the rear end margin 87 is shredded. Further, the transport roller pair 60 transports the shredded piece SP downstream from the upstream of the cutting unit 56.

As illustrated in FIG. 13, the printer 11 includes the accommodation portion 28 that accommodates the cut pieces WP being cutting chips generated by cutting the cutform paper CP. When the cutting unit 56 cuts off the leading end margin 86 and the rear end margin 87 of the cutform paper CP, the cut pieces WP falls down as cutting chips. In this case, the reception port 29 and the accommodation portion 28 of the accommodation container 17 are arranged below the cutting unit 56. Thus, the accommodation container 17 is configured to accommodate the cut pieces WP generated when the cutting unit 56 cuts the medium P. Note that cutting chips accommodated in the accommodation container 17 include the shredded pieces SP generated at the time of shredding the rear end margin 87 and the leading end margin 86.

Further, in a state in which the upper blade being a movable blade is at the cutting position, the discharge roller pair 62 rotates backward. With this, the shredded piece SP nipped between the discharge roller pair 62 is transported upstream. At this moment, the shredded piece SP falls down in the accommodation container 17. The discharge roller pair 62 has a configuration of performing nipping at an angle with respect to the vertical direction Z. Thus, when the discharge roller pair 62 transports the nipped shredded piece SP upstream, and the shredded piece SP falls down in the accommodation container 17, the upstream end of the shredded piece SP abuts from obliquely above on the surface of the upper blade at the cutting position. With this, the shredded piece SP falls down along the surface of the upper blade.

Figure 14:
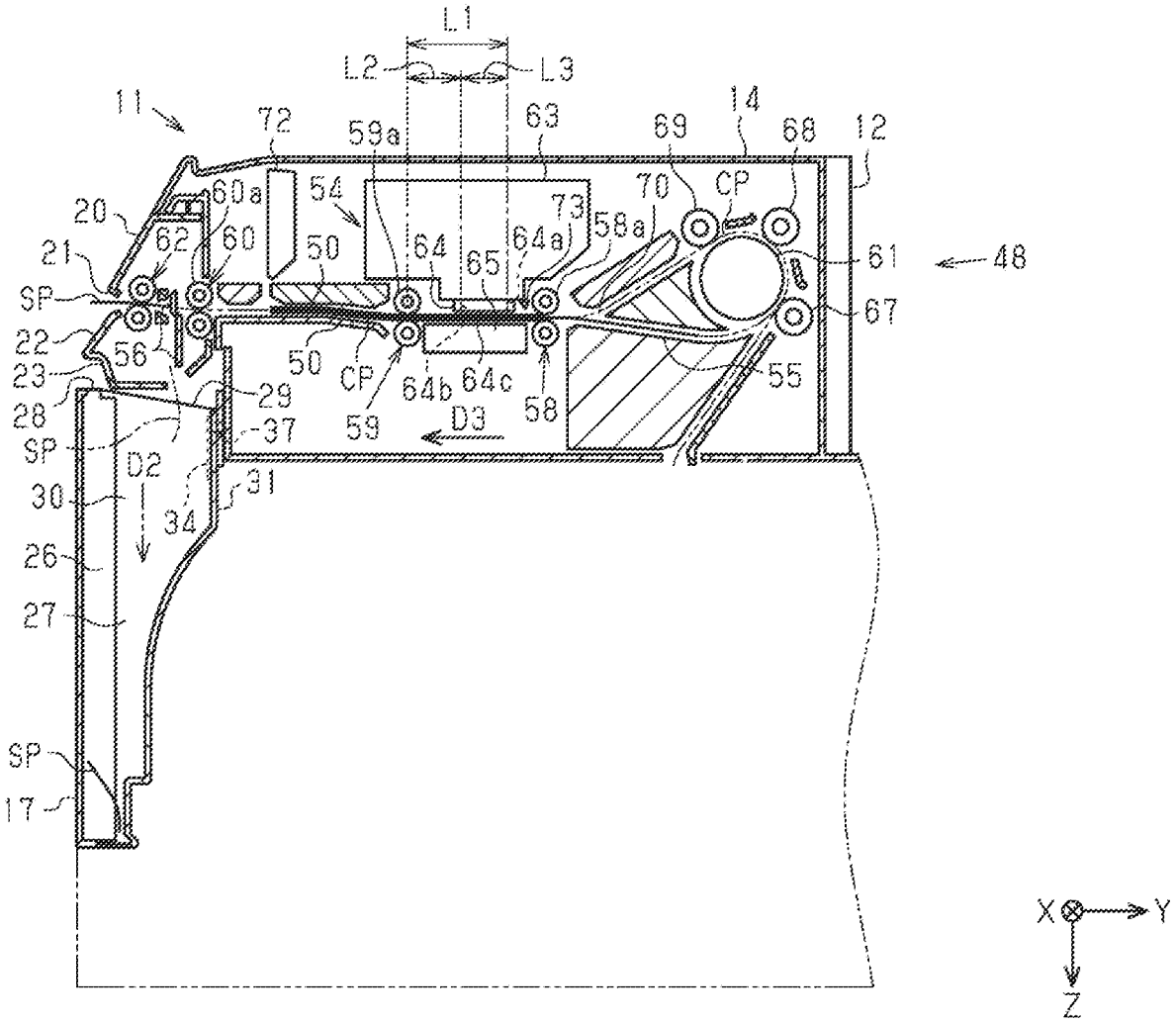
FIG. 14 is a schematic cross-sectional view illustrating a state in which an upstream shredded piece falls down after shredding the leading end margin on the second surface of the medium subjected to duplex printing.

As illustrated in FIG. 14, the upper blade being a movable blade is temporarily lifted up, and the remaining shredded piece SP is transported to the position downstream of the upper blade, and is nipped between the discharge roller pair 62. Further, after the upper blade being a movable blade moves to the cutting position again, the discharge roller pair 62 rotates backward. At this moment, the remaining shredded piece SP also falls down in the accommodation container 17.

After causing the cutting unit 56 to cut the cutform paper CP at the position between the cut position 97 and the first end 81, the control unit 53 causes the cutting unit 56 to cut the cutform paper CP at a position between the reference end 96 and the second end 82. Specifically, after cutting off the cut piece WP corresponding to the rear end margin 87, the cut piece WP corresponding to the leading end margin 86 is cut off.

As illustrated in FIG. 11, in the present exemplary embodiment, the cut piece WP corresponding to the leading end margin 86 of the cutform paper CP is cut off at a time. A part from which the cut piece WP corresponding to the leading end margin 86 and the cut piece WP corresponding to the rear end margin 87 are cut off is referred to as the "printed object OP". The discharge roller pair 62 illustrated in FIG. 2 discharges the printed object OP to the outside of the housing unit 12 illustrated in FIG. 2.

Figure 16:
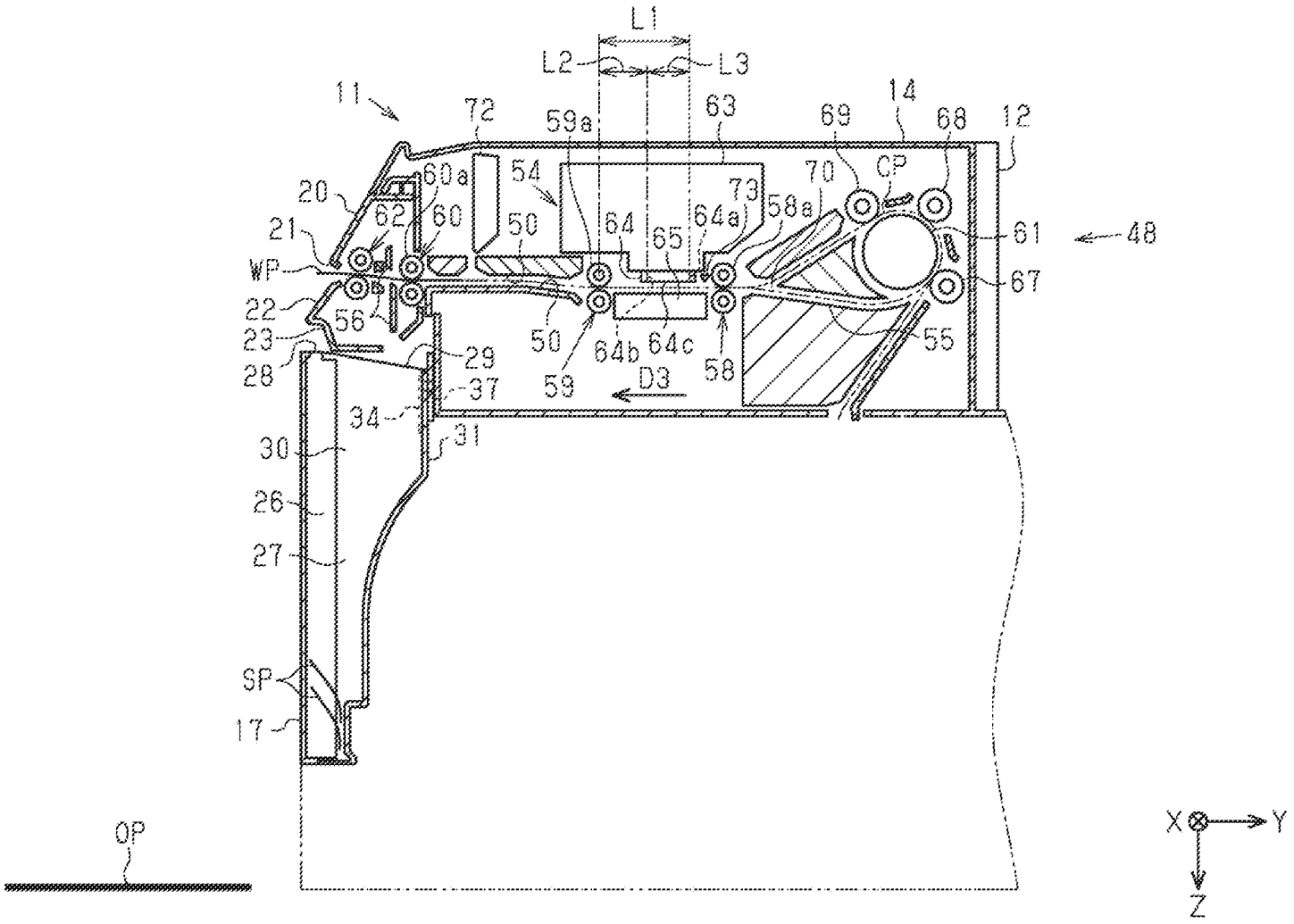
FIG. 16 is a schematic cross-sectional view illustrating a state in which a downstream shredded piece falls down after shredding the rear end margin on the second surface of the medium subjected to duplex printing.

As illustrated in FIG. 16, the leading end margin 86 illustrated in FIG. 11 may be shredded. In the present exemplary embodiment, after cutting off the cut piece WP corresponding to the leading end margin 86, the control unit 53 causes the cutting unit 56 to cut the cut piece WP at the position between the reference end 96 being an end of the cut piece WP and the second end 82. In this manner, the cut piece WP corresponding to the leading end margin 86 that is cut off from the cut piece WP including the first printing region 91 is cut at the position between the reference end 96 and the second end 82. With this, the leading end margin 86 is shredded. Note that, of the part that is cut off by cutting the medium P at the position between the reference end 96 and the second end 82, a part in which the first printing region 91 is not formed is referred to as the shredded piece SP. Further, when shredding the leading end margin 86, the cutting unit 56 may cut the cut piece WP at a plurality of positions between the reference end 96 and the second end 82.

Note that, as shredding of the leading end margin 86, the cutting unit 56 may have a configuration of cutting the cutform paper CP at the position between the reference end 96 and the second end 82 before cutting the cutform paper CP at the second end 82. In this case, the cutting unit 56 may also cut the cutform paper CP at the plurality of positions between the reference end 96 and the second end 82.

Figure 17:
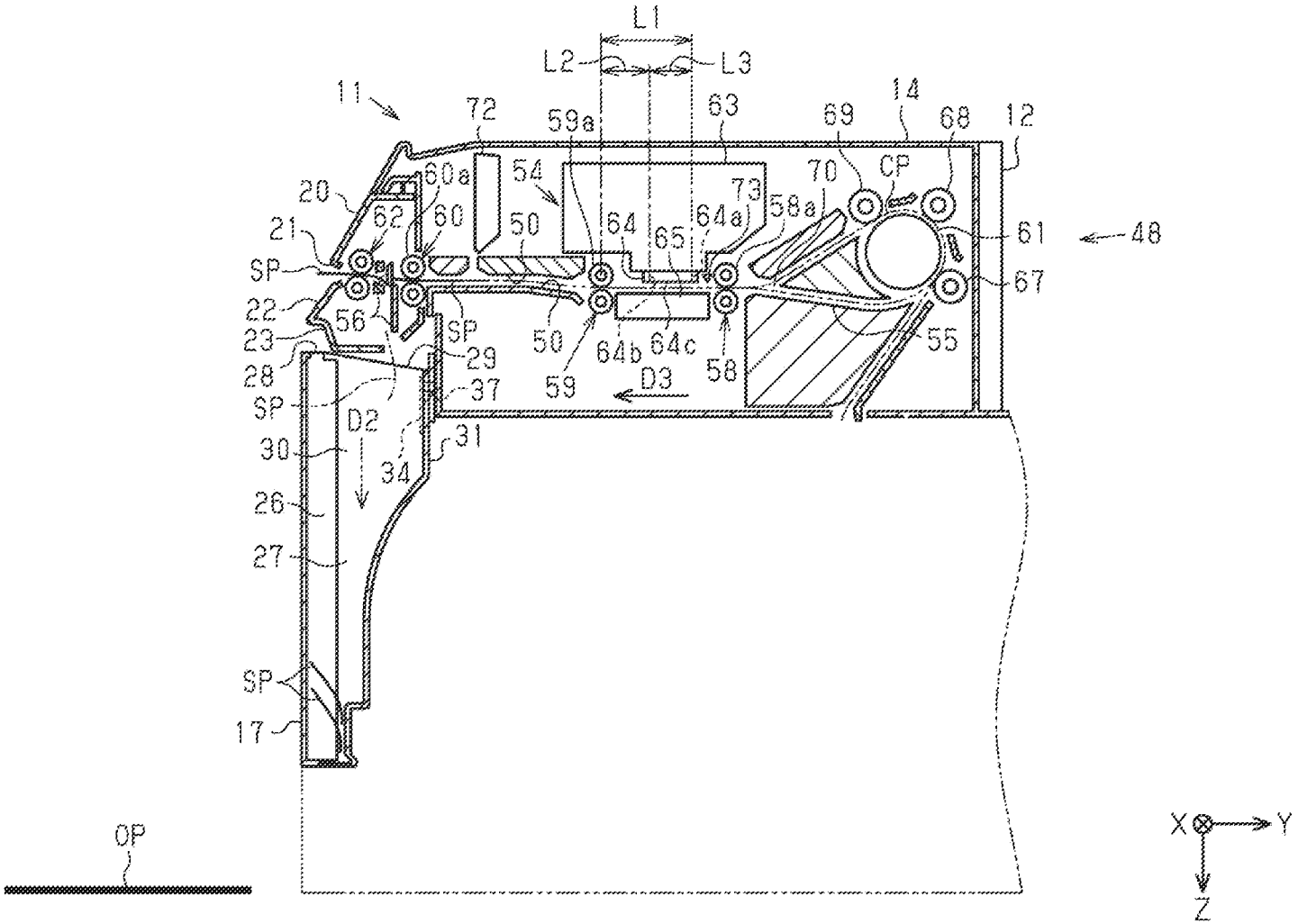
FIG. 17 is a schematic cross-sectional view illustrating a state in which an upstream shredded piece falls down after shredding the rear end margin on the second surface of the medium subjected to duplex printing.

As illustrated in FIG. 17, in the present exemplary embodiment, the control unit 53 causes the cutting unit 56 to cut the cut piece WP in a state in which the transport roller pair 60 and the discharge roller pair 62 nip the cut piece WP corresponding to the leading end margin 86. With this, the leading end margin 86 is shredded.

Further, in a state in which the upper blade being a movable blade is at the cutting position, the discharge roller pair 62 rotates backward. With this, the shredded piece SP nipped between the discharge roller pair 62 is transported upstream. At this moment, the shredded piece SP falls down in the accommodation container 17.

Figure 18:
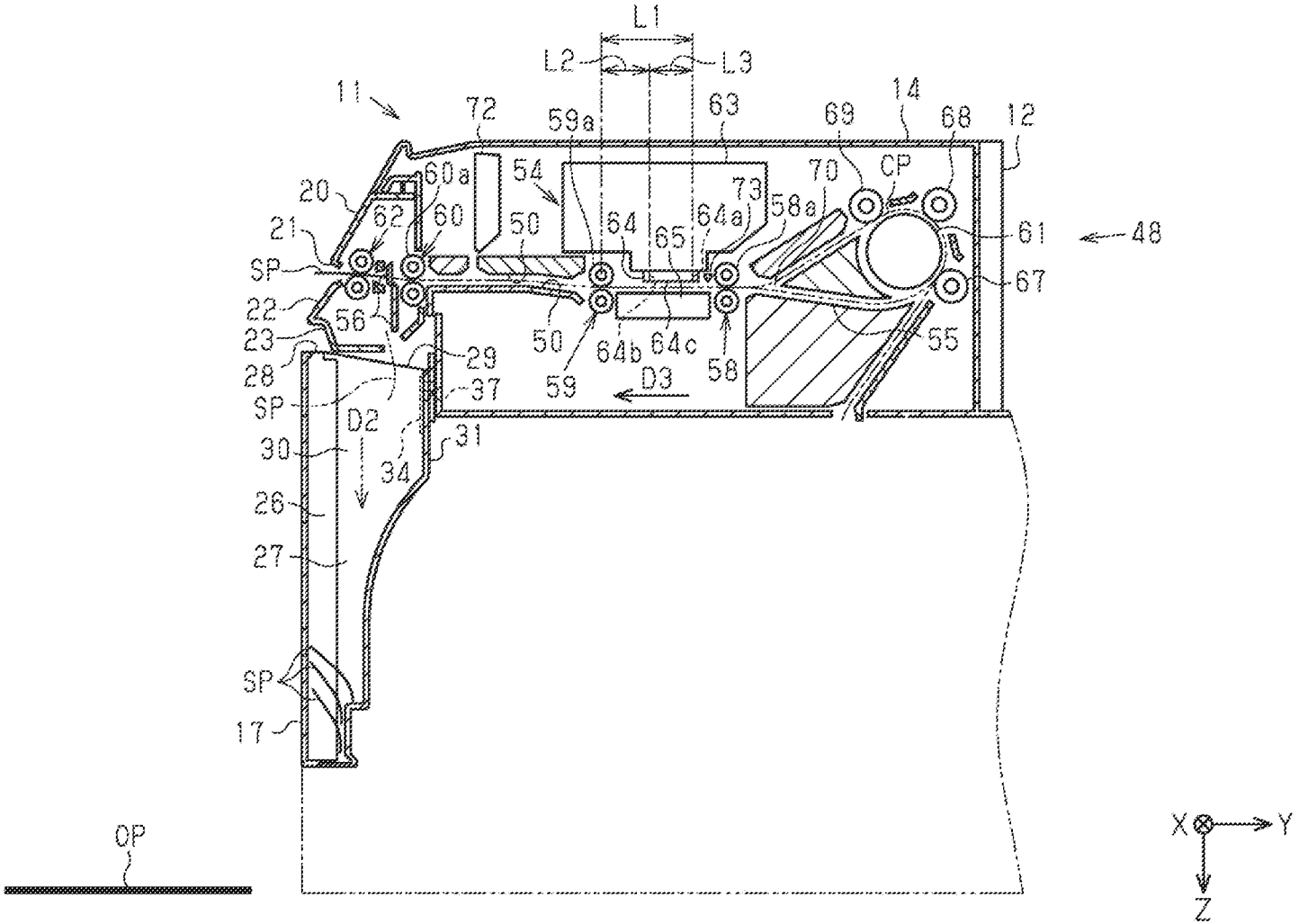
FIG. 18 is a schematic cross-sectional view illustrating a state in which a printed object is output to an outside of a housing unit.

As illustrated in FIG. 18, the upper blade being a movable blade is temporarily lifted up, and the remaining shredded piece SP is transported to the position downstream of the upper blade, and is nipped between the discharge roller pair 62. The upper blade being a movable blade moves to the cutting position again, and the discharge roller pair 62 rotates backward. At this moment, the remaining shredded piece SP also falls down in the accommodation container 17.

In the present exemplary embodiment, a configuration in which the cutting unit 56 cuts the leading end margin 86 and the rear end margin 87, which are illustrated in FIG. 6, from the cutform paper CP is adopted. However, the printer 11 may not include the cutting unit 56. Specifically, in a state in which the elongated medium P is fed from the roll body RP in a state of being wound up in a roll shape, a part of the medium P subjected to printing at least on the first surface is discharged to the outside of the housing unit 12. A user cuts off the rear end of the discharged medium P at a freely-selected position, and thus the cutform paper CP is formed. Then, a user cuts off a margin of the cutform paper CP. Such a configuration may be adopted.

In this case, there may be adopted a configuration in which the printer 11 does not include the switchback transport path 55 illustrated in FIG. 2 that transports the cutform paper CP below the printing unit 54 in a state in which the second surface thereof faces the printing unit 54 after the transport unit 48 switchbacks the cutform paper CP upstream after printing is performed on the first surface.

Further, in this case, the printer 11 may include a manual insertion supply path that communicate the upstream of the printing unit 54 and the outside of the housing unit 12 with each other. To an inserter capable of suppling the cutform paper CP to the manual insertion supply path, a user may set the cutform paper CP after printing is performed on the first surface and with a margin which is not cut out, in such a way that the reference end 96 illustrated in FIG. 6 is positioned downstream in the transport direction D3 and that the second surface of the cutform paper CP after printing is performed on the first surface is transported below the printing unit 54 in a state of facing the printing unit 54. When printing is performed on the first surface of the cutform paper CP, the control unit 53 determines a distance from the reference end 96 illustrated in FIG. 6 to the second end 82 illustrated in FIG. 6. Thus, the control unit 53 can match a position of a third end 83 of the cutform paper CP, which is illustrated in FIG. 9, with the position of the second end 82, which is illustrated in FIG. 9.

Further, as illustrated in FIG. 9, in a state in which the leading end margin 88 and the rear end margin 89 of the cutform paper CP are left, the cutform paper CP after printing is performed on both the surfaces is discharged to the outside of the housing unit 12. Then, a user cuts off the leading end margin 88 and the rear end margin 89 of the discharged cutform paper CP. In this manner, the printed object OP illustrated in FIG. 11 is output. Such a configuration may be adopted.

In the present exemplary embodiment, the printer 11 performs printing on the first surface of the medium P unwound from the roll body RP during duplex printing. However, a configuration in which both printing on the first surface and printing on the second surface are performed on the cutform paper CP may be adopted. For example, a configuration in which the printer 11 includes a cassette that accommodates the cutform paper CP, and printing on the first surface and printing on the second surface are performed on the cutform paper CP transported from the cassette is conceivable. In this configuration, printing on the first surface and printing on the second surface are also started in the nipped state.

Next, actions of the present exemplary embodiment are described.

As illustrated in FIG. 1, when the roll body RP is loaded in the drawer unit 16, the drawer unit 16 is pulled out, and the roll body RP is set to the side wall portions 43. Further, the leading end of the medium P unwound from the roll body RP is manually inserted into the insertion port 44. Subsequently, the positioning member 47 moves, and the medium P is positioned on the −X side in the width direction X.

As illustrated in FIG. 2, the leading end of the medium P advances further behind the insertion port 44, and contacts with the transport roller pair 51. Then, the first sensor 71 detects the leading end of the medium P, the transport roller pair 51 slightly rotates, and thus the leading end of the medium P is drawn in and nipped between the transport roller pair 51. When the drawer unit 16 is restored from the pulled-out state to the original state illustrated in FIG. 2, the medium P is transported downstream by the transport roller pairs 51, 52, and 57, the roll body RP rotates in the counter-clockwise direction, and the leading end of the medium P is transported to the standby position illustrated in FIG. 2 before the printer 11 starts an operation. Thus, preparation for printing is completed.

Figure 19:
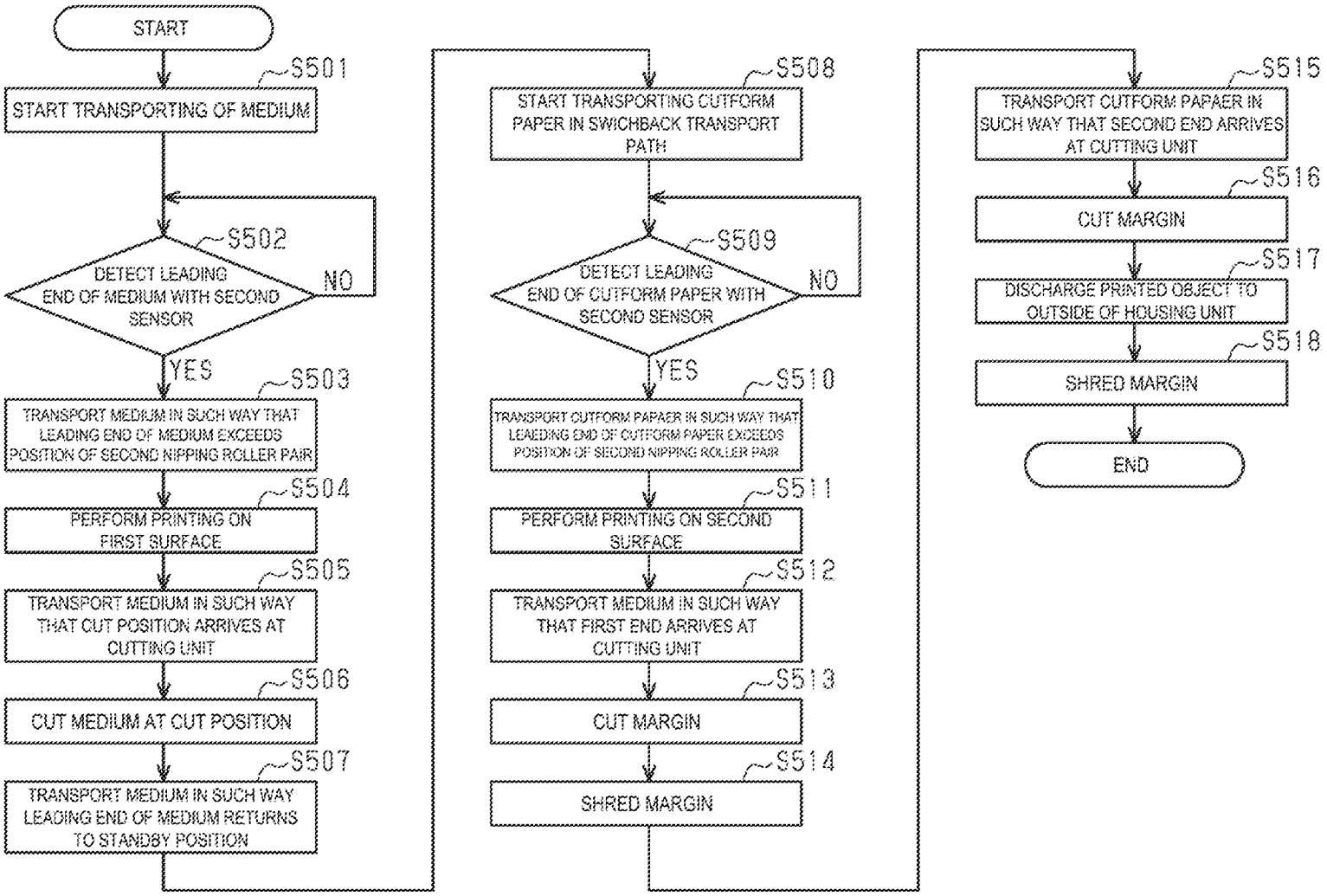
FIG. 19 is a flowchart illustrating a flow of control during duplex printing.

Hereinafter, with reference to the flowchart in FIG. 19, description is made on a flow of control during duplex printing for outputting a printed object being the medium P after performing printing on the first surface and the second surface and an effect in each operation.

In Step S501, the control unit 53 causes the transport unit 48 to start transporting the elongated medium P, which is fed from the roll body RP in a state of being wound up in a roll shape, downstream.

In Step S502, the control unit 53 determines whether the second sensor 73 detects passing of the leading end of the medium P. As illustrated in FIG. 3, when the second sensor 73 detects passing of the leading end of the medium P, as Step S503, the control unit 53 causes the transport unit 48 to transport the medium P by the transport amount M. With this, the leading end of the medium P is positioned at the printing start position P1.

As illustrated in FIG. 3, in a state in which the leading end of the medium P is nipped by the first nipping roller pair 59, the control unit 53 starts printing on the first surface of the medium P, as Step S504. In Step S504, the first printing region 91 is formed on the first surface of the medium P. In the present exemplary embodiment, when the printing unit 54 starts formation of the first printing region 91, printing on the first surface in Step S504 is started. Further, in the present exemplary embodiment, when the printing unit 54 terminates formation of the first printing region 91, printing on the first surface in Step S504 is terminated. Further, the control unit 53 causes the printing unit 54 to form the first end 81 on the medium P, and then terminates printing on the first surface as Step S504.

In the present exemplary embodiment, the first surface of the medium P is the outer circumferential surface of the roll body RP. When the medium P is nipped by the second nipping roller pair 58, and the reference end 96 being the leading end of the medium P passes on the support unit 65 toward the first nipping roller pair 59, the inner circumferential surface of the medium P faces the support unit 65.

Due to Step S503, the leading end of the medium P is positioned at the printing start position P1 downstream of the first nipping position. Thus, in a state in which the medium P is nipped by the first nipping roller pair 59, printing on the first surface in Step S504 is started. Therefore, even when curling caused in the roll body RP still remains on the medium P, a deformation amount of the leading end of the medium P is limited within a certain range.

In Step S511 described later in the present exemplary embodiment, the end of the medium P is curled toward the liquid jetting unit 64 due to curling of the roll body RP when the control unit 53 causes the printing unit 54 to perform printing on the second surface of the medium P, and a deformation amount in the Z direction is largest at the leading end and the rear end of the medium P. The rear end of the medium P in printing on the second surface is the reference end 96 being the leading end in printing on the first surface.

The control unit 53 may cause the transport unit 48 and the printing unit 54 to control the position at which the first printing region 91 is formed in such a way that the distance between the second end 82 of the first surface and the reference end 96 is greater than the distance in the transport direction D3 between the position of the second nipping roller pair 58 and the most downstream nozzle 64*b*. The control unit 53 causes the transport unit 48 and the printing unit 54 to start printing on the first surface in such a way that the distance between the second end 82 and the reference end 96 is greater than the distance in the transport direction D3 between the position of the second nipping roller pair 58 and the most downstream nozzle 64*b*. With this, in a state in which the medium P is nipped by the second nipping roller pair 58, formation of the second printing region 92 is terminated. With this, a deformation amount of the rear end of the medium P is limited within a certain range.

Specifically, in Step S504, in the nipped state, the control unit 53 causes the printing unit to start printing on the first surface of the medium P and to form the first printing region 91 on the medium P. As a result, even in an ink-jet type in which a gap is generated between the printing unit 54 and the medium P and the medium P is easily curled during printing, a deformation amount of a part of the medium P, which faces the printing unit 54, is limited within a certain range during printing on the first surface. Further, in Step S504, the first end 81 is formed on the medium P, and then the control unit 53 terminates printing on the first surface.

In Step S505, after printing on the first surface is terminated, the control unit 53 causes the transport unit 48 to transport the medium P in such a way that the cut position 97 arrives at the cutting unit 56.

In Step S511 described later in the present exemplary embodiment, the end of the medium P is curled toward the liquid jetting unit 64 due to curling of the roll body RP when the control unit 53 causes the printing unit 54 to perform printing on the second surface of the medium P, and a deformation amount in the Z direction is largest at the leading end and the rear end of the medium P. The leading end of the medium P in printing on the second surface corresponds to the cut position 97 in printing on the first surface.

The control unit 53 sets the cut position 97 in such a way that the distance between the first end 81 and the cut position 97 is greater than the most upstream nozzle distance L1 being the distance between the position of the first nipping roller pair 59 and the most upstream nozzle 64*a* in the transport direction D3. With this setting, when the first end 81 is positioned at the position corresponding to the most upstream nozzle 64*a* in the transport direction D3, the cut position 97 being the leading end of the medium P when the second surface faces vertically upward is positioned downstream of the first nipping position. Specifically, while positioning the cut position 97 downstream of the first nipping position, the control unit 53 can position the first end 81 upstream of the position corresponding to the most upstream nozzle 64*a*. Thus, in a state in which the cut position 97 is positioned downstream of the first nipping position, in other words, in the nipped state, the fourth end 84 can be formed at the position corresponding to the position of the first end 81 on the inside and the outside of the medium P. Therefore, in the nipped state, the control unit 53 can start printing on the second surface, that is, form the second printing region 92 at the position corresponding to the first printing region 91 on the inside and the outside of the medium P. With this, a deformation amount of the end of the medium P at the time of starting printing on the second surface is limited within a certain range.

As illustrated in FIG. 5, in Step S506, the control unit 53 causes the cutting unit 56 to cut the medium P at the cut position 97. The cutform paper CP is cut off from the medium P.

As illustrated in FIG. 7, in Step S507, the control unit 53 causes the transport unit 48 to position the leading end of the medium P at the standby position.

In Step S508, the control unit 53 causes the transport unit 48 to start transporting of the cutform paper CP in the switchback transport path 55. The cutform paper CP to be transported in the switchback transport path 55 moves toward the second sensor 73 via the intermediation roller 61.

In Step S509, the control unit 53 determines whether the second sensor 73 detects passing of the leading end of the cutform paper CP. As illustrated in FIG. 8, when the second sensor 73 detects passing of the leading end of the medium P, as Step S510, the control unit 53 causes the transport unit 48 to transport the cutform paper CP. With this, the leading end of the cutform paper CP is positioned at the printing start position P2. The printing start position P2 is downstream of the first nipping position. Further, in the present exemplary embodiment, the printing start position P2 is set within such a range that the first end 81 is positioned upstream of the most downstream nozzle 64*b* when the leading end of the cutform paper CP is positioned at the printing start position P2. Thus, in the nipped state, the fourth end 84 can be formed at the position corresponding to the first end 81 on the inside and the outside of the medium P.

In the present exemplary embodiment, the second surface is the inner circumferential surface of the roll body RP in a state of being wound up in a roll shape. When the medium P is nipped by the second nipping roller pair 58, and the reference end 96 being the leading end of the medium P passes on the support unit 65 toward the first nipping roller pair 59, the inner circumferential surface of the medium P is oriented toward the liquid jetting unit 64.

In Step S511, the control unit 53 controls the printing unit 54, and performs printing on the second surface of the medium P in a state in which the leading end of the medium P is nipped by the first nipping roller pair 59. In Step S511, the second printing region 92 is formed on the medium P. Printing on the second surface in Step S511 is started when the printing unit 54 starts formation of the second printing region 92, and is terminated when formation of the second printing region 92 is terminated.

Note that, when printing on the second surface is started, the cutform paper CP is nipped by the second nipping roller pair 58. Thus, printing on the second surface is started in the nipped state in which the cutform paper CP is nipped by the first nipping roller pair 59 and nipped by the second nipping roller pair 58. Thus, a deformation amount at the end of the cutform paper CP in printing on the second surface is limited within a certain range. Therefore, even in a configuration in which printing on the second surface is performed with respect to the medium P having a moisture content changed after printing on the first surface, a deformation amount at the end of the cutform paper CP is limited within a certain range, and hence the second printing region 92 can be formed at a desired position corresponding to the first printing region 91.

Further, the control unit 53 terminates printing on the second surface in the nipped state. Thus, the second printing region 92 can be formed at a desired position corresponding to the first printing region 91.

As illustrated in FIG. 10, in Step S512, the control unit 53 causes the transport unit 48 to transport the cutform paper CP in such a way that the fourth end 84 of the second surface arrives at the cutting unit 56 after terminating printing on the second surface.

In Step S513, the control unit 53 causes the cutting unit 56 to cut the cutform paper CP at the fourth end 84 of the second surface. The cutform paper CP is cut in a state of being nipped between the transport roller pair 60 and the discharge roller pair 62 in an unmovable and fixed manner. Thus, the cutform paper CP is cut accurately at the fourth end 84. The cutform paper CP is divided into the cut piece WP.

Further, as illustrated in FIG. 12, the control unit 53 causes the transport unit 48 to transport the cut piece WP in such a way that the center of the cut piece WP being the leading end margin 88 of the second surface and the rear end margin 87 of the first surface, which is illustrated in FIG. 11, arrives at the cutting unit 56, and to transport the cutform paper CP upward by a predetermined distance. As long as the cutform paper CP is away from the cut piece WP by a slight amount or more, the distance is not limited.

As illustrated in FIG. 13, in Step S514, the control unit 53 causes the cutting unit 56 to cut the cut piece WP in half. The cut piece WP is divided into two shredded pieces SP. With regard to one shredded piece SP nipped between the discharge roller pair 62, the discharge roller pair 62 is reversed in a state in which the upper blade of the cutting unit 56 is at the cutting position. With this, the upper end of the shredded piece SP abuts on the upper blade of the cutting unit 56, falls down in a falling direction D2 to the +Z side in the vertical direction Z, and is accommodated in the accommodation container 17. The printer 11 includes the accommodation portion 28 that accommodates cut pieces generated by cutting the medium P. With this, a user is not required to dispose cut pieces every time printing is performed.

Further, the control unit 53 causes the cutting unit 56 to move the upper blade to the retraction position. In this state, the control unit 53 causes the transport unit 48 to transport the other shredded piece SP, which is nipped between the transport roller pair 60, downstream of the cutting unit 56. Then, the shredded piece SP is nipped between the discharge roller pair 62. The distance between the transport roller pair 60 and the discharge roller pair 62 is smaller than at least a half of the margin distance 89*a*, that is, the length of the shredded piece SP in the transport direction D3. Thus, the shredded piece SP is transported downstream of the cutting unit 56.

As illustrated in FIG. 14, the control unit 53 causes the cutting unit 56 to move the upper blade to the cutting position again, and the discharge roller pair 62 is reversed in this state. With this, the upper end of the shredded piece SP abuts on the upper blade of the cutting unit 56, falls down in the falling direction D2 to the +Z side in the vertical direction Z, and is accommodated in the accommodation container 17. A cut piece, which is generated from the rear end margin 87 of the first surface between the downstream end of the medium P in the transport direction D3 and the first end 81, is shredded. With this, the cut piece is less likely to remain in the transport path 49.

Note that Step S514 may not be performed. Instead, in Step S513, with regard to the cut piece WP nipped between the discharge roller pair 62, when the discharge roller pair 62 is reversed in a state in which the upper blade of the cutting unit 56 is at the cutting position, the cut piece WP may be accommodated in the accommodation container 17.

Figure 15:
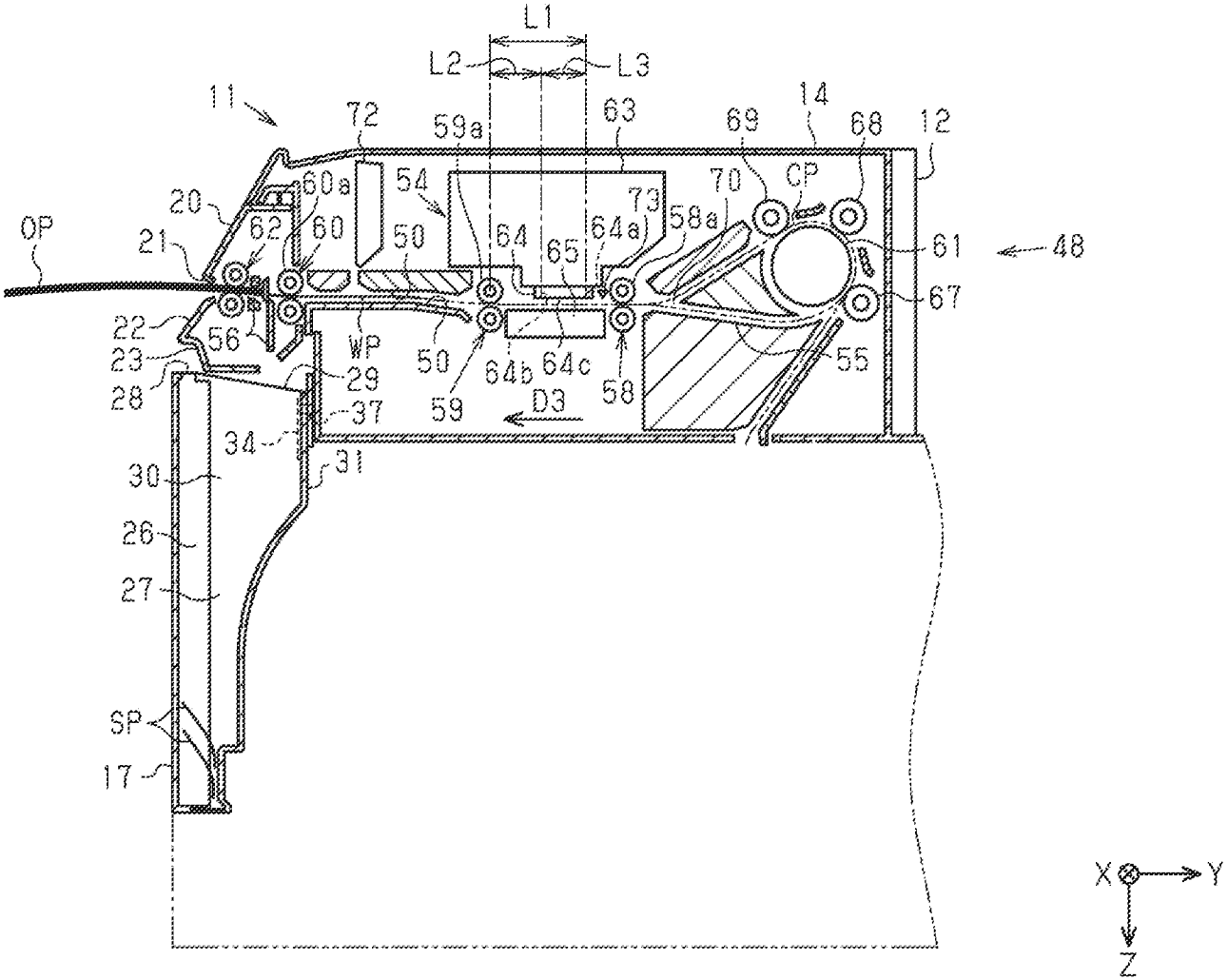
FIG. 15 is a schematic cross-sectional view illustrating a cut state of the rear end on the second surface of the medium subjected to duplex printing.

As illustrated in FIG. 15, in Step S515 and S516, the control unit 53 causes the transport unit 48 to transport the cutform paper CP in such a way that the third end 83 of the second surface arrives at the cutting unit 56. Further, the control unit 53 causes the cutting unit 56 to cut the cutform paper CP at the third end 83 of the second surface. The cutform paper CP is cut in a state of being nipped between the transport roller pair 60 and the discharge roller pair 62 in an unmovable and fixed manner. Thus, the cutform paper CP is cut accurately at the third end 83. The cutform paper CP is divided into the printed object OP and the cut piece WP.

After causing the printing unit 54 to perform printing on the second surface of the elongated medium P, which is fed from the roll body RP in a state of being wound up in a roll shape, the control unit 53 causes the cutting unit 56 to cut the medium P at the first end 81 of the first printing region 91 and the second end 82 of the first printing region 91. When the medium P is transported to the printing start position at the time of performing printing on the first surface, the medium P is nipped by the first nipping roller pair 59, and the part of the medium P, which is downstream of the printing unit 54 in the transport direction D3, is nipped by the second nipping roller pair 58. Further, the medium P is nipped, and a deformation amount of the end of the medium P is limited within a certain range. Further, the medium P is cut at the cut position 97 positioned upstream of the first end 81 of the medium P. With this, when the medium P is transported to the printing start position at the time of performing printing on the second surface, the medium P is nipped by the first nipping roller pair 59. At this moment, the second surface is the inner circumferential surface. Thus, even when the medium P is lifted due to curling, the part of the medium P, which is downstream of the printing unit 54 in the transport direction D3, is also nipped by the first nipping roller pair 59 in printing on the second surface, similarly to printing on the first surface. Further, the part of the medium P, which is upstream of the printing unit 54 in the transport direction D3, is nipped by the second nipping roller pair 58. With this, a deformation amount of the end of the medium P is limited within a certain range.

In Step S517, the discharge roller pair 62 discharged the printed object OP to the outside of the housing unit 12. Specifically, the printed object OP is output.

As illustrated in FIG. 16, in Step S518, the control unit 53 causes the transport unit 48 to transport the cut piece WP in such a way that the center of the cut piece WP being the rear end margin 89 of the second surface and the leading end margin 86 of the first surface arrives at the cutting unit 56.

Further, as illustrated in FIG. 17, the control unit 53 causes the cutting unit 56 to cut the cut piece WP into half. The cut piece WP is divided into two shredded pieces SP. With regard to one shredded piece SP nipped between the discharge roller pair 62, the discharge roller pair 62 is reversed in a state in which the upper blade of the cutting unit 56 is at the cutting position. With this, the upper end of the shredded piece SP abuts on the upper blade of the cutting unit 56, falls down in a falling direction D2 to the +Z side in the vertical direction Z, and is accommodated in the accommodation container 17. A cut piece, which is generated from the leading end margin 86 of the first surface between the upstream end of the medium P in the transport direction D3 and the second end 82, is shredded. With this, the cut piece is less likely to remain in the transport path 49.

Further, the control unit 53 causes the cutting unit 56 to move the upper blade to the retraction position. In this state, the control unit 53 causes the transport unit 48 to transport the other shredded piece SP, which is nipped between the transport roller pair 60, downstream of the cutting unit 56. Then, the shredded piece SP is nipped between the discharge roller pair 62. The distance between the transport roller pair 60 and the discharge roller pair 62 is smaller than at least a half of the margin distance 89*a*, that is, the length of the shredded piece SP in the transport direction D3. Thus, the shredded piece SP is transported downstream of the cutting unit 56.

As illustrated in FIG. 18, the control unit 53 causes the cutting unit 56 to move the upper blade to the cutting position again, and the discharge roller pair 62 is reversed in this state. With this, the upper end of the shredded piece SP abuts on the upper blade of the cutting unit 56, falls down in the falling direction D2 to the +Z side in the vertical direction Z, and is accommodated in the accommodation container 17.

Note that, instead of performing Step S518, in Step S517, the control unit 53 may causes the transport unit 48 to transport the cut piece WP, which is nipped between the transport roller pair 60, downstream of the cutting unit 56 in a state in which the cutting unit 56 is caused to move the upper blade to the retraction position, and the cut piece WP may be nipped between the discharge roller pair 62. Further, with regard to the cut piece WP nipped between the discharge roller pair 62 in a state in which the control unit 53 causes the cutting unit 56 to move the upper blade at the cutting position, when the discharge roller pair 62 is reversed in a state in which the upper blade of the cutting unit 56 is at the cutting position, the cut piece WP may be accommodated in the accommodation container 17.

In the present exemplary embodiment, a decurler that corrects a curl of the medium P, which is caused by curling of the roll body RP, is not included in the configuration of the printer 11. The medium P in a curled state is used in the printer 11. As described above, the printer 11 of the present exemplary embodiment is configured to perform printing with the ink-jet type printing unit 54 even when a curl is formed on the medium P at a certain degree. Thus, the printer 11 of the present exemplary embodiment can be used for a medium including an ink reception layer in which a crack is easily generated when spreading the medium outward of a curl curve in order to correct the curl. The ink reception layer fixes dye and develops a color near the surface of the medium, and hence the color is developed vividly on the printed object OP immediately after printing. As a result, sharp black and abundant color are achieved. Note that a decurler having a curling correction force that is weak enough to prevent breakage of the ink reception layer can be included in the configuration.

The flow of control and the effect in each operation in the present exemplary embodiment are described above.

Effects of the present exemplary embodiment are described.

(1) When the medium P is in the nipped state of being nipped by the first nipping roller pair 59 and the second nipping roller pair 58, the control unit 53 causes the printing unit 54 to start printing on the first surface of the medium P. Further, the control unit 53 causes the printing unit 54 to form the first printing region 91 on the medium P, and to start printing on the second surface of the medium P when the medium P having the first printing region 91 formed is in the nipped state. With this, the second printing region 92 is formed on the medium P. When the part of the medium P, which is downstream of the printing unit 54, is nipped by the first nipping roller pair 59, and the part of the medium P, which is upstream of the printing unit 54, is nipped by the second nipping roller pair 58, printing on the first surface and the second surface of the medium P is performed. As a result, even in an ink-jet type in which a gap is generated between the printing unit 54 and the medium P and the medium P is easily curled during printing, a deformation amount of a part of the medium P, which faces the printing unit 54, is limited within a certain range during printing. Thus, positional deviation between the ends of the images on both the surfaces can be suppressed.

(2) An excessive margin is added by a variable amount to the leading end of the medium P in accordance with a leading end margin amount in a printing image region based on printing image data, in such a way that the leading end of the medium P is at the position downstream of the first nipping position in the transport direction D3. The control unit 53 adds a minimum excessive margin to the leading end of the medium P, in accordance with the leading end margin amount in the printing image region based on the printing image data. Specifically, a margin amount at the leading end of the medium P is reduced, and hence an amount of the medium P, which is used for printing on one sheet, can be reduced. Further, the medium P is nipped by the first nipping roller pair 59 downstream of the printing unit 54 and by the second nipping roller pair 58 upstream of the printing unit 54, and hence a deformation amount of the end of the medium P is limited within a certain range. Thus, positional deviation between the ends of the images on both the surfaces can be suppressed.

(3) After causing the printing unit 54 to start printing on the second surface and to form the second printing region 92 on the medium P, and causing the printing unit 54 to perform printing on the second surface of the cutform paper CP, the control unit 53 causes the cutting unit 56 to cut the medium P at the first end 81 of the first printing region 91 and the second end 82 of the first printing region 91. Specifically, when the medium P is transported to the printing start position at the time of performing printing on the first surface, and also when the medium P is transported to the printing start position at the time of performing printing on the second surface, the medium P is nipped by the first nipping roller pair 59, and the part of the medium P, which is downstream of the printing unit in the transport direction D3, is nipped by the second nipping roller pair 58. Further, the medium P is nipped, and a deformation amount of the end of the medium P is limited within a certain range. Thus, positional deviation between the ends of the images on both the surfaces can be suppressed.

(4) The cut position 97 is a position obtained by adding, to the upstream of the first end 81 of the first printing region 91, an excessive margin by a variable amount, in accordance with the leading end margin amount in the printing image region based on the printing image data. The control unit 53 causes the cutting unit 56 to cut the medium P at the cut position 97. The cut position 97 is positioned upstream of the first end 81 being the upstream end of the first printing region 91 formed on the first surface, and is obtained by adding, to the upstream of the first end 81 of the first printing region 91, a minimum excessive margin in accordance with the leading end margin amount in the printing image region based on the printing image data. Specifically, the margin distances 87*a* and 88*a* at the rear end of the first surface being the leading end of the second surface of the medium P are reduced, and hence an amount of the medium P, which is used for printing on one sheet, can be reduced. Further, the medium P is nipped by the first nipping roller pair 59 downstream of the printing unit 54 and by the second nipping roller pair 58 upstream of the printing unit, and hence a deformation amount of the end of the medium P is limited within a certain range. Thus, positional deviation between the ends of the images on both the surfaces can be suppressed.

(5) The margin distance 87*a* is the distance in the transport direction between the first end 81 of the first printing region 91 and the cut position 97. The margin distance 87*a* is greater than the most upstream nozzle distance L1 being the distance in the transport direction between the most upstream nozzle 64*a* of the printing unit 54 and the position at which the first nipping roller pair 59 nips the medium P. The control unit 53 can cause the leading end of the medium P to be nipped by the first nipping roller pair 59 while positioning the first end 81 upstream of the most upstream nozzle 64*a*. Further, the second nipping roller pair 58 transports the medium P. With this, printing is performed. Thus, in a state in which the first end 81 is positioned upstream of the most upstream nozzle 64*a*, the control unit 53 can cause the medium P to be in the nipped state being nipped by the first nipping roller pair 59 and the second nipping roller pair 58. Therefore, even when the fourth end 84 is formed with any one of the nozzles, the control unit 53 can start formation of the fourth end 84 in the nipped state. In the nipped state, a deformation amount of the medium P is limited within a certain range. Thus, accuracy of duplex printing for forming the second printing region at the position corresponding to the first printing region is improved.

(6) The cutting unit 56 includes the accommodation portion 28 that accommodates cut pieces generated by cutting the medium P. The printer 11 includes the accommodation portion 28 that accommodates cut pieces generated by cutting the medium P. With this, a user can collectively dispose cut pieces for a plurality of times instead of disposing cut pieces every time printing is performed.

(7) After causing the printing unit 54 to perform printing on the second surface of the medium P, the control unit 53 causes the cutting unit 56 to cut the medium P at the position between the downstream end of the medium P in the transport direction D3 and the first end 81. A cut piece, which is generated between the downstream end of the medium P in the transport direction D3 and the first end 81, is shredded, and the cut piece is less likely to remain in the transport path 49. With this, a risk of causing a jam can be lowered.

(8) After causing the printing unit 54 to perform printing on the second surface of the medium P, the control unit 53 causes the cutting unit 56 to cut the medium P at the position between the upstream end of the medium P in the transport direction D3 and the second end 82. A cut piece, which is generated between the downstream end of the medium P in the transport direction D3 and the second end 82, is shredded, and the cut piece is less likely to remain in the transport path 49. With this, a risk of causing a jam can be lowered.

(9) When the printing unit 54 performs printing on the elongated medium P, which is fed from the roll body RP in a state of being wound up in a roll shape, the second surface is the inner circumferential surface positioned inside of the roll body RP. After printing is performed on the second surface being the inner circumferential surface of the elongated medium P, which is fed from the roll body RP in a state of being wound up in a roll shape, the control unit 53 causes the cutting unit 56 to cut the medium P at the first end 81 of the first printing region 91 and the second end 82 of the first printing region 91. The medium P is cut at the cut position 97 positioned upstream of the first end 81 of the medium P. With this, when the medium P is transported to the printing start position at the time of performing printing on the second surface, the medium P is nipped by the first nipping rollers. At this moment, the second surface is the inner circumferential surface. Thus, even when the medium P is lifted due to curling, the part of the medium P, which is downstream of the printing unit 54 in the transport direction D3, is also nipped by the first nipping roller pair in printing on the second surface, similarly to printing on the first surface. Further, the part of the medium P, which is upstream of the printing unit 54 in the transport direction D3, is nipped by the second nipping rollers, and hence a deformation amount of the end of the medium P is limited within a certain range. After printing is performed on the second surface of the medium P in the nipped state, the cutting unit 56 cuts the medium P at the first end 81 and the second end 82. Thus, positional deviation between the ends of the images on both the surfaces can be suppressed.

(10) In the control method of the printer 11, the control unit 53 causes the printing unit 54 to start printing on the first surface of the medium P in the nipped state and to form the first printing region 91 on the medium P. Further, in the control method of the printer 11, after the first printing region 91 is formed on the medium P, the control unit 53 causes the printing unit 54 to start printing on the second surface of the medium P in the nipped state and to form the second printing region 92 on the medium P.

According to this method, an action effect similar to the item (1) described above can be obtained.

(11) The distance between the second end 82 and the reference end 96 is greater than the distance between the position of the second nipping roller pair 58 and the most downstream nozzle 64*b* in the transport direction D3. Thus, in printing on the second surface, the rear end of a curl of the medium P is suppressed by the second nipping roller pair 58. The end of the medium P is curled toward the liquid jetting unit 64 due to curling of the roll body RP in printing on the second surface, and a deformation amount in the Z direction is largest at the leading end and the rear end of the medium P. The rear end of the medium P in printing on the second surface is the reference end 96 being the leading end in printing on the first surface. The control unit 53 causes the transport unit 48 and the printing unit 54 to start printing on the first surface in such a way that the distance between the second end 82 and the reference end 96 is greater than the distance in the transport direction D3 between the position of the second nipping roller pair 58 and the most downstream nozzle 64*b*. With this, while the medium P is nipped by the second nipping roller pair 58, the second end 82 can be positioned downstream of the most downstream nozzle 64*b*. Specifically, even when the third end 83 is formed at the position corresponding to the second end 82 with any one of the nozzles, the medium P can be nipped by the second nipping roller pair 58 at the time of forming the third end 83. Therefore, at the time of terminating formation of the second printing region 92, a deformation amount at the rear end of the medium P is limited within a certain range. Thus, accuracy of duplex printing for forming the second printing region 92 at the position corresponding to the first printing region 91 is improved.

The present exemplary embodiment described above may be modified as follows. The present exemplary embodiment and modified examples thereof to be described below may be implemented in combination within a range in which a technical contradiction does not arise.

After the second sensor 73 detects the leading end of the medium P, the second nipping roller pair 58 transports the leading end of the medium P by the transport amount, to the position downstream of the first nipping position in the transport direction D3. The transport amount may be set depending on a type of the roll body RP to be used. A curl amount of the medium P differs depending on a type of the medium P included in the roll body RP or a diameter of a core member being the center of the roll body RP that is wound in a roll shape. Specifically, when a curl of the medium P is large, a transport amount is set to be greater than that in a case in which a curl of the medium P is small. Otherwise, the leading end of the medium P may not be transported to the position downstream of the position of the most downstream nozzle 64*b* in the transport direction D3 in some cases. The transport amount is set depending on a type of the roll body RP to be used. With this, when causing the printing unit 54 to start printing, the control unit 53 can cause the transport unit 48 to transport the leading end of the medium P to the position downstream of the position of the most downstream nozzle 64*b* in the transport direction D3.

After the second sensor 73 detects the leading end of the medium P, the second nipping roller pair 58 transports the leading end of the medium P by the transport amount, to the position downstream of the first nipping position in the transport direction D3. The transport amount may be set by detecting a curl amount of the medium P to be used. A sensor that measures a curl amount may be provided in the vicinity of the second sensor 73, and the control unit 53 may determine the transport amount in accordance with an output from the sensor.

After the second sensor 73 detects the leading end of the medium P, the second nipping roller pair 58 transports the leading end of the medium P by the transport amount, to the position downstream of the first nipping position in the transport direction D3. The transport amount may be set by detecting an outer diameter of the roll body RP to be used. A curl amount of the medium P differs depending on the outer diameter of the roll body RP wound in a roll shape. Thus, when the roll body RP is used, a curl amount is increased as the diameter is reduced. Thus, a sensor that detects the diameter of the roll body RP wound in a roll shape may be provided, and the control unit 53 may determine the transport amount in accordance with an output from the sensor.

In the present exemplary embodiment, the control unit 53 performs control in accordance with received printing image data. Alternatively, the control unit 53 may execute processing in accordance with printing image data provided inside the printer 11. For example, the control unit 53 may perform control in accordance with a printing image data piece selected by a user from a plural pieces of printing image data stored in an internal memory of the printer 11, or may perform control in accordance with printing image data stored in a memory inserted into a memory slot in the printer 11.

A sensor that detects arrival of the leading end of the medium P at the first nipping roller pair 59 may be provided. A sensor that detects paper may be provided downstream of the first nipping roller pair 59 and in the vicinity of the first nipping roller pair 59, and the sensor may detect arrival of the leading end of the medium P at the downstream of the first nipping roller pair 59. Further, a sensor that detects a thickness of the medium P may be provided to the first nipping roller pair 59, and the sensor may detect that the leading end of the medium P is nipped by the first nipping roller pair 59. In a state in which the sensor detects that the leading end of the medium P is nipped by the first nipping roller pair 59, printing is started. With this, a deformation amount of the end of the medium P is limited within a certain range. Thus, positional deviation between the ends of the images on both the surfaces can be suppressed, the length of the margin at the leading end can be shortened.

In the present exemplary embodiment, the medium P is nipped between the roller pairs at the first nipping position and the second nipping position, but the method of nipping the medium P is not limited to the roller pairs. For example, the medium P may be nipped between a roller and the transport surface 50, the medium P may be nipped between a belt pair, or the medium P may be nipped between a belt and the transport surface 50.

In the present exemplary embodiment, the discharge roller pair 62 has a configuration of solely rotating in both forward and backward directions and stopping, but instead of solely rotating, the discharge roller pair 62 may rotate in synchronization with the second nipping roller pair 58, the first nipping roller pair 59, and the transport roller pair 60. Particularly, in a case in which the cut piece WP is not further shredded, after the cut piece WP is cut and divided from the leading end of the medium P, the discharge roller pair 62 transports the cut piece WP upstream in a state in which the position of the upper blade is at the cutting position. With this, the cut piece WP falls downs, and is accommodated in the accommodation container 17. Further, also in a case in which the cut piece WP is cut and divided from the rear end of the cutform paper CP, the discharge roller pair 62 transports the cut piece WP upstream in a state in which the position of the upper blade is at the cutting position. With this, the cut piece WP falls downs, and is accommodated in the accommodation container 17. Thus, a risk in that the end of the cut piece WP and the end of the cutform paper CP abut on each other is avoided.

In the present exemplary embodiment, the cut piece WP is shredded into two, but the number of shredded pieces is not limited to two. The cut piece WP may be shredded into smaller pieces. When the distance between the transport roller pair 60 and the cutting unit 56 and the distance between the discharge roller pair 62 and the cutting unit 56 is set to be small, the cut piece WP can be shredded into smaller pieces.

In the present exemplary embodiment, the discharge roller pair 62 has a configuration of performing nipping at an angle with respect to the vertical direction Z, and hence the discharge roller pair 62 can cause the shredded piece SP to fall down along the surface of the upper blade. However, a plurality of roller pairs may be provided downstream of the cutting unit 56 to achieve a configuration of securely transporting the shredded piece SP downward. Further, an inclination surface is provided on the surface of the upper blade, specifically, at a part on which the upstream end of the shredded piece SP is caused to abut by the discharge roller pair 62 when the discharge roller pair 62 causes the shredded piece SP to fall down along the surface of the upper blade, and the upstream end of the shredded piece SP moves along the inclination surface. With this, a configuration of transporting the shredded piece SP downward may be achieved.

In the present exemplary embodiment, the control unit 53 controls the position of the medium P with the two sensors including the first sensor 71 and the second sensor 73, but the positions and the number of sensors that detect the medium P are not limited. For example, the position of the second sensor 73 may be in the vicinities of the pinch rollers 67, 68, and 69. In the present exemplary embodiment, the printer 11 includes the second sensor 73 at the position between the second nipping roller pair 58 and the liquid jetting unit 64 and in the vicinity of the second nipping roller pair 58. Thus, the printing position can be controlled accurately. Further, a sensor that enables the control unit 53 to stop the leading end of the medium P at the standby position more accurately may be provided in the vicinity of the outlet 42. Alternatively, a sensor that enables the control unit 53 to stop the medium P at the cutting position more accurately may be provided upstream of the cutting unit 56 and in the vicinity of the cutting unit 56.

Hereinafter, technical concepts and effects thereof that are understood from the above-described exemplary embodiments and modified examples will be described.

(A) A printer includes a printing unit configured to perform printing on a medium being transported in a transport direction, a first nipping roller configured to nip the medium at a first nipping position downstream of the printing unit in the transport direction in which the medium is transported, a second nipping roller configured to nip the medium at a second nipping position upstream of the printing unit in the transport direction in which the medium is transported, and a control unit configured to control the printing unit, wherein during duplex printing for outputting a printed object obtained by performing printing on a first surface and a second surface of the medium, the control unit causes the printing unit to start printing on the first surface in a nipped state in which the medium is nipped by the first nipping roller and is nipped by the second nipping roller, and causes the printing unit to start printing on the second surface in the nipped state after the printing unit performs printing on the first surface of the medium.

With this configuration, both printing on the first surface of the medium and printing on the second surface of the medium are started in the nipped state in which the medium is nipped downstream of the printing unit and being nipped upstream of the printing unit. A deformation amount of the medium at the time of starting printing is limited within a certain range. Thus, a difference between a deformation amount of the medium at the time of starting printing on the first surface and a deformation amount of the medium at the time of starting printing on the second surface is small. Therefore, a risk that the position of the printing region formed on the other surface with respect to the printing region formed on the one surface is deviated from the desired position is lowered.

(B) The above-mentioned printer may include a cutting unit configured to cut the medium after printing is performed by the printing unit, wherein in the duplex printing, the control unit may cause the printing unit to form a first printing region at the first surface as printing on the first surface, the cutting unit to cut the medium at a cut position positioned upstream of a first end being an upstream end of the first printing region of the medium having the first surface facing the printing unit, the printing unit to form a second printing region at the second surface as printing on the second surface when the medium formed with the first printing region and cut at the cut position is in the nipped state, and the cutting unit to cut the medium at the first end of the first printing region and a second end of the first printing region in a state in which the second surface faces the printing unit.

With this configuration, after printing is performed on the second surface, the control unit causes the cutting unit to cut the medium at the first end of the first printing region and the second end of the first printing region. Thus, in the nipped state, the margin part nipped by the first nipping roller and the margin part nipped by the second nipping roller are cut off by the cutting unit. Therefore, while lowering a risk that the position of the second printing region with respect to the first printing region is deviated from the desired position, a user can obtain the printed object from which the margin parts are cut.

(C) In the above-mentioned printer, a distance in the transport direction between the first end of the first printing region and the cut position may be greater than a distance in the transport direction between the first nipping position and a most upstream nozzle of the printing unit.

With this configuration, while positioning the first end upstream of the most upstream nozzle, the leading end of the medium can be nipped by the first nipping roller pair. Thus, even when any one of the nozzles in the transport direction forms the fourth end of the medium, formation of the second printing region can be started in the nipped state. Therefore, accuracy of duplex printing for forming the second printing region at the position corresponding to the first printing region is improved.

(D) The above-mentioned printer may include an accommodation portion configured to accommodate a cut piece generated by cutting the medium.

With this configuration, the cut pieces generated by cutting the medium are accommodated in the accommodation portion. With this, without discharging the cut pieces through the discharge port for discharging the printed object, the cut pieces can be accommodated in the accommodation portion. Further, a user can collectively dispose the cut pieces for a plurality of times instead of disposing the cut pieces every time printing is performed.

(E) In the above-mentioned printer, the control unit may cause the cutting unit to cut the medium at a position between a downstream end of the medium in the transport direction and the first end in a state in which the second surface faces the printing unit.

With this configuration, the margin between the downstream end of the medium in the transport direction and the first end at the time of performing printing on the second surface is shredded. The cut pieces are less likely to remain in the transport path without being accommodated in the accommodation portion. Thus, a transport error due to the cut pieces remaining in the transport path and staining of the medium can be suppressed.

(F) In the above-mentioned printer, the control unit may cause the cutting unit to cut the medium at a position between an upstream end of the medium in the transport direction and the second end in a state in which the second surface faces the printing unit.

With this configuration, the margin between the upstream end of the medium in the transport direction and the second end at the time of performing printing on the second surface is shredded. The cut pieces are less likely to remain in the transport path without being accommodated in the accommodation portion. Thus, a transport error due to the cut pieces remaining in the transport path and staining of the medium can be suppressed.

(G) In the above-mentioned printer, the control unit may cause the printing unit to perform printing on the medium having an elongated shape fed from a roll body in a state of being wound up in a roll shape, and the second surface may be an inner circumferential surface positioned inside of the roll body.

With this configuration, the control unit can start printing on the inner circumferential surface being the second surface of the elongated medium, which is fed from the roll body, in the nipped state. The medium fed out from the roll body is likely to be deformed due to change in moisture content when ink is applied. Particularly when printing is performed on the inner circumferential surface, the medium is deformed more easily than a case in which printing is performed on the outer circumferential surface. In this case, the weight of the medium itself acts in such a way as to suppress deformation of the medium. Specifically, with this configuration, particularly when printing is started on the inner circumferential surface being the second surface of the medium, which is easily deformed, a deformation amount at end of the medium is limited within a certain range. Therefore, when duplex printing is performed, a risk that the position of the image region formed on the other surface with respect to the image region formed on the one surface is deviated from the desired position is lowered.

(H) A control method of the above-mentioned printer is a control method of a printer including a printing unit configured to perform printing on a medium being transported in a transport direction, a first nipping roller configured to nip the medium at a first nipping position upstream of the printing unit in the transport direction in which the medium is transported, a second nipping roller configured to nip the medium at a second nipping position downstream of the printing unit in the transport direction in which the medium is transported, and a control unit configured to control the printing unit. A state in which the medium is nipped by the first nipping roller and by the second nipping roller is referred to as a nipped state. During duplex printing for outputting a printed object obtained by performing printing on a first surface and a second surface of the medium, in the control method, the control unit causes the printing unit to start printing on the first surface of the medium in the nipped state and to form a first printing region at the medium, and causes the printing unit to start printing on the second surface of the medium in the nipped state after the first printing region is formed on the medium, and to form a second printing region at the medium.

According to this method, an action effect similar to the item (A) described above can be obtained.

What is claimed is:

1. A printer, comprising:

a printing unit configured to perform printing on a medium being transported in a transport direction;

a first nipping roller configured to nip the medium at a first nipping position downstream of the printing unit in the transport direction in which the medium is transported;

a second nipping roller configured to nip the medium at a second nipping position upstream of the printing unit in the transport direction in which the medium is transported; and a control unit configured to control the printing unit, wherein during duplex printing for outputting a printed object obtained by performing printing on a first surface and a second surface of the medium, the control unit causes the printing unit to start printing on the first surface in a nipped state in which the medium is nipped by the first nipping roller and is nipped by the second nipping roller, and causes the printing unit to start printing on the second surface of the medium, after the printing unit performs printing on the first surface, in the nipped state in which the medium is nipped by the first nipping roller and is nipped by the second nipping roller, wherein the first nip roller for printing on the first surface is the same as the first nip roller for printing on the second surface, and the second nip roller for printing on the first surface is the same as the second nip roller for printing on the second surface.

2. The printer according to claim 1, comprising:

a cutting unit configured to cut the medium after printing is performed by the printing unit, wherein in the duplex printing, the control unit causes:

the printing unit to form a first printing region at the first surface as the printing on the first surface;

the cutting unit to cut the medium at a cut position positioned upstream of a first end being an upstream end of the first printing region of the medium having the first surface facing the printing unit;

the printing unit to form a second printing region at the second surface as the printing on the second surface when the medium formed with the first printing region and cut at the cut position is in the nipped state; and the cutting unit to cut the medium at the first end of the first printing region and a second end of the first printing region in a state in which the second surface faces the printing unit.

3. The printer according to claim 2, wherein a distance in the transport direction between the first end of the first printing region and the cut position is greater than a distance in the transport direction between the first nipping position and a most upstream nozzle of the printing unit.

4. The printer according to claim 2, comprising:

an accommodation portion configured to accommodate a cut piece generated by cutting of the medium.

5. The printer according to claim 2, wherein the control unit causes the cutting unit to cut the medium at a position between a downstream end of the medium in the transport direction and the first end in a state in which the second surface faces the printing unit.

6. The printer according to claim 2, wherein the control unit causes the cutting unit to cut the medium at a position between an upstream end of the medium in the transport direction and the second end in a state in which the second surface faces the printing unit.

7. The printer according to claim 1, wherein the control unit causes the printing unit to perform printing on the medium having an elongated shape fed from a roll body in a state of being wound up in a roll shape, and the second surface is an inner circumferential surface positioned inside of the roll body.

8. A control method of a printer, the printer including:

a printing unit configured to perform printing on a medium being transported in a transport direction;

a first nipping roller configured to nip the medium at a first nipping position upstream of the printing unit in the transport direction in which the medium is transported; and a second nipping roller configured to nip the medium at a second nipping position downstream of the printing unit in the transport direction in which the medium is transported, the method comprising: during duplex printing for outputting a printed object obtained by performing printing on a first surface and a second surface of the medium, causing the medium to be in a nipped state of being nipped by the first nipping roller and by the second nipping roller;

causing the printing unit to start printing on the first surface of the medium in the nipped state; and causing the printing unit to start printing on the second surface of the medium in the nipped state in which the medium is nipped by the first nipping roller and is nipped by the second nipping roller, after a first printing region is formed at the first surface of the medium, wherein the first nip roller for printing on the first surface is the same as the first nip roller for printing on the second surface, and the second nip roller for printing on the first surface is the same as the second nip roller for printing on the second surface.

* * * * *